US011885221B2

(12) United States Patent
Hren

(10) Patent No.: US 11,885,221 B2
(45) Date of Patent: Jan. 30, 2024

(54) SHOVEL STABILIZER APPENDAGE

(71) Applicant: Joy Global Surface Mining Inc, Milwaukee, WI (US)

(72) Inventor: William J. Hren, Wauwatosa, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 694 days.

(21) Appl. No.: 16/282,454

(22) Filed: Feb. 22, 2019

(65) Prior Publication Data

US 2019/0264506 A1 Aug. 29, 2019

Related U.S. Application Data

(60) Provisional application No. 62/635,635, filed on Feb. 27, 2018.

(51) Int. Cl.

| | |
|---|---|
| ***E21B 7/02*** | (2006.01) |
| ***E02F 9/08*** | (2006.01) |
| ***E02F 9/02*** | (2006.01) |

(52) U.S. Cl.

CPC ..... *E21B 7/024* (2013.01); *E02F 9/085* (2013.01); *E02F 9/02* (2013.01)

(58) Field of Classification Search

CPC ..... E21B 7/024; E21B 15/006; E02F 9/085; E02F 9/02

(Continued)

(56) References Cited

U.S. PATENT DOCUMENTS 3,109,542 A * 11/1963 Noll ..... E02F 9/14 212/195
4,275,902 A * 6/1981 Teja ..... B66C 23/78 212/304

(Continued)

FOREIGN PATENT DOCUMENTS

CN 2732843 Y 10/2005
CN 1711398 A 12/2005

(Continued)

OTHER PUBLICATIONS

Komatsu Brochure—P&H 4100XPC-AC90, URL: https://www.komatsu.com/en/products/electric-rope-shovels/4100xpc/#specifications click download brochure, pub date of 2018 (Year: 2018).*

(Continued)

*Primary Examiner* — Joshua G Kotis
*Assistant Examiner* — Scott A Howell
(74) *Attorney, Agent, or Firm* — Husch Blackwell LLP

(57) ABSTRACT

A mining machine includes a base having two drive tracks configured to rest on a ground surface and to move the mining machine along a first direction. The drive tracks each have a length along the first direction between a front end of the drive track and a rear end of the drive track. The mining machine further includes a carbody that extends between the two drive tracks, a turntable coupled to the carbody that defines an axis of rotation, and a stabilizer appendage coupled to the carbody. The stabilizer appendage extends forward from the carbody along the first direction and includes a roller or plate to contact the ground surface and provide stabilizing support during a digging operation. The axis of rotation is positioned closer to the front end of the drive tracks than the rear end of the drive tracks.

20 Claims, 31 Drawing Sheets

(58) Field of Classification Search
USPC ..... 173/187; 280/763.1, 1.202; 180/20; 212/301
See application file for complete search history.

(56) References Cited

U.S. PATENT DOCUMENTS

| | | | | |
|---|---|---|---|---|
| 4,369,989 | A * | 1/1983 | Mankey | E02F 9/085 254/422 |
| 4,401,408 | A | 8/1983 | Gibert | |
| 6,202,013 | B1 | 3/2001 | Anderson et al. | |
| 6,668,471 | B1 | 12/2003 | Cook et al. | |
| 7,114,747 | B2 | 10/2006 | Dix et al. | |
| 7,378,950 | B2 * | 5/2008 | Lehnen | B66C 3/04 212/277 |
| 8,756,839 | B2 | 6/2014 | Hren et al. | |
| 8,768,581 | B2 | 7/2014 | Mizuochi et al. | |
| 8,798,874 | B2 * | 8/2014 | Taylor | E02F 9/2033 701/50 |
| 8,943,714 | B2 | 2/2015 | Hren | |
| 9,015,969 | B2 | 4/2015 | Knuth | |
| 9,211,832 | B1 * | 12/2015 | Secker | E02F 3/964 |
| 9,365,398 | B2 | 6/2016 | Benton et al. | |
| 9,382,685 | B2 | 7/2016 | Maki et al. | |
| 9,550,475 | B1 | 1/2017 | Walker et al. | |
| 10,273,655 | B2 | 4/2019 | Colwell et al. | |
| 10,718,097 | B2 | 7/2020 | Hren et al. | |
| 2007/0083312 | A1 * | 4/2007 | Lehnen | E02F 9/24 701/50 |
| 2010/0283675 | A1 * | 11/2010 | McAree | E02F 3/435 342/357.28 |
| 2012/0101693 | A1 * | 4/2012 | Taylor | E02F 9/2033 701/50 |
| 2013/0280021 | A1 | 10/2013 | Knuth | |
| 2016/0122972 | A1 * | 5/2016 | Price | E02F 3/325 180/312 |
| 2016/0200556 | A1 | 7/2016 | Zwifka et al. | |

FOREIGN PATENT DOCUMENTS

| | | | |
|---|---|---|---|
| CN | 1784333 | A | 6/2006 |
| CN | 104775459 | A | 7/2015 |
| CN | 205954723 | U | 2/2017 |
| CN | 210194719 | U | 3/2020 |
| GB | 1356548 | A | 6/1974 |
| WO | 2009004343 | | 1/2009 |
| WO | 2017004389 | | 1/2017 |

OTHER PUBLICATIONS

Search Report and Examiner's Report issued by the Chilean Patent Office for Application No. 201900524 dated Jun. 5, 2020 (21 pages including statement of relevance).

Wacker Neuson, "EW65—Wheeled excavator offers power and mobility", <https://www.wackerneuson.us/en/products/excavators/wheeled-excavators/model/ew65-1/>, webpage accessed Jun. 22, 2017.

Fanotech, "Roll off Hoist Model TFR60 HD", <http://www.fanotech.ca/mobile-products-fanotech-enviro-inc/roll-off-hoist-model-tfr60-hd>, webpage accessed Jun. 22, 2017.

Chinese Patent Office Action for Application No. 201910147174.3 dated May 27, 2022 (18 pages including an English translation).

* cited by examiner

SHOVEL STABILIZER APPENDAGE

CROSS-REFERENCE TO RELATED APPLICATIONS

This application claims priority to U.S. Provisional Application No. 62/635,635, filed Feb. 27, 2018, the entire contents of which are incorporated herein by reference.

FIELD OF THE INVENTION

The present invention relates to stabilizer appendages, and more specifically to stabilizer appendages for a mining shovel.

Industrial mining machines, such as electric rope or power mining shovels, draglines, etc., are used to execute digging operations to remove material from a bank of a mine. On a conventional rope shovel, a dipper is attached to a handle, and the dipper is supported by a cable, or rope, that passes over a boom sheave. The rope is secured to a bail that is pivotably coupled to the dipper. The handle is moved along a saddle block to maneuver a position of the dipper. During a hoist phase, the rope is reeled in by a winch in a base of the machine, lifting the dipper upward through the bank and liberating the material to be dug. To release the material disposed within the dipper, a dipper door is pivotally coupled to the dipper. When not latched to the dipper, the dipper door pivots away from a bottom of the dipper, thereby freeing the material out through a bottom of the dipper.

SUMMARY

In accordance with another construction, a mining machine includes a base having two drive tracks configured to rest on a ground surface and to move the mining machine along a first direction. The drive tracks each have a length along the first direction between a front end of the drive track and a rear end of the drive track. The mining machine further includes a carbody that extends between the two drive tracks, a turntable coupled to the carbody that defines an axis of rotation, and a stabilizer appendage coupled to the carbody. The stabilizer appendage extends forward from the carbody along the first direction and provides stabilizing support during a digging operation. The axis of rotation is positioned closer to the front ends of the drive tracks than the rear ends of the drive tracks.

In accordance with another construction, a mining machine includes a base having two drive tracks and a carbody that extends between the two drive tracks. The carbody includes a turntable. The turntable is coupled to a frame, and defines an axis of rotation of the frame relative to the drive tracks. A boom is coupled to the frame, and a dipper is coupled to the boom, such that the frame, the boom, and the dipper rotate about the axis of rotation. The rotation of the dipper about the axis of rotation defines a swing profile of the dipper. A stabilizer appendage is coupled to the carbody. The stabilizer appendage provides stabilizing support during a digging operation. The two drive tracks and the stabilizer appendage are positioned such that the swing profile is uninterrupted by the drive tracks and the stabilizer appendage when the dipper is in a fully tucked position.

In accordance with another construction, a mining machine includes a base having two drive tracks configured to rest on a ground surface and to move the mining machine along a first direction. The mining machine further includes a carbody that extends between the two drive tracks, and a stabilizer appendage coupled to the carbody. The stabilizer appendage extends forward from the carbody along the first direction and provides stabilizing support during a digging operation. The drive tracks and carbody define a square outer profile when viewed along a direction perpendicular to the first direction.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
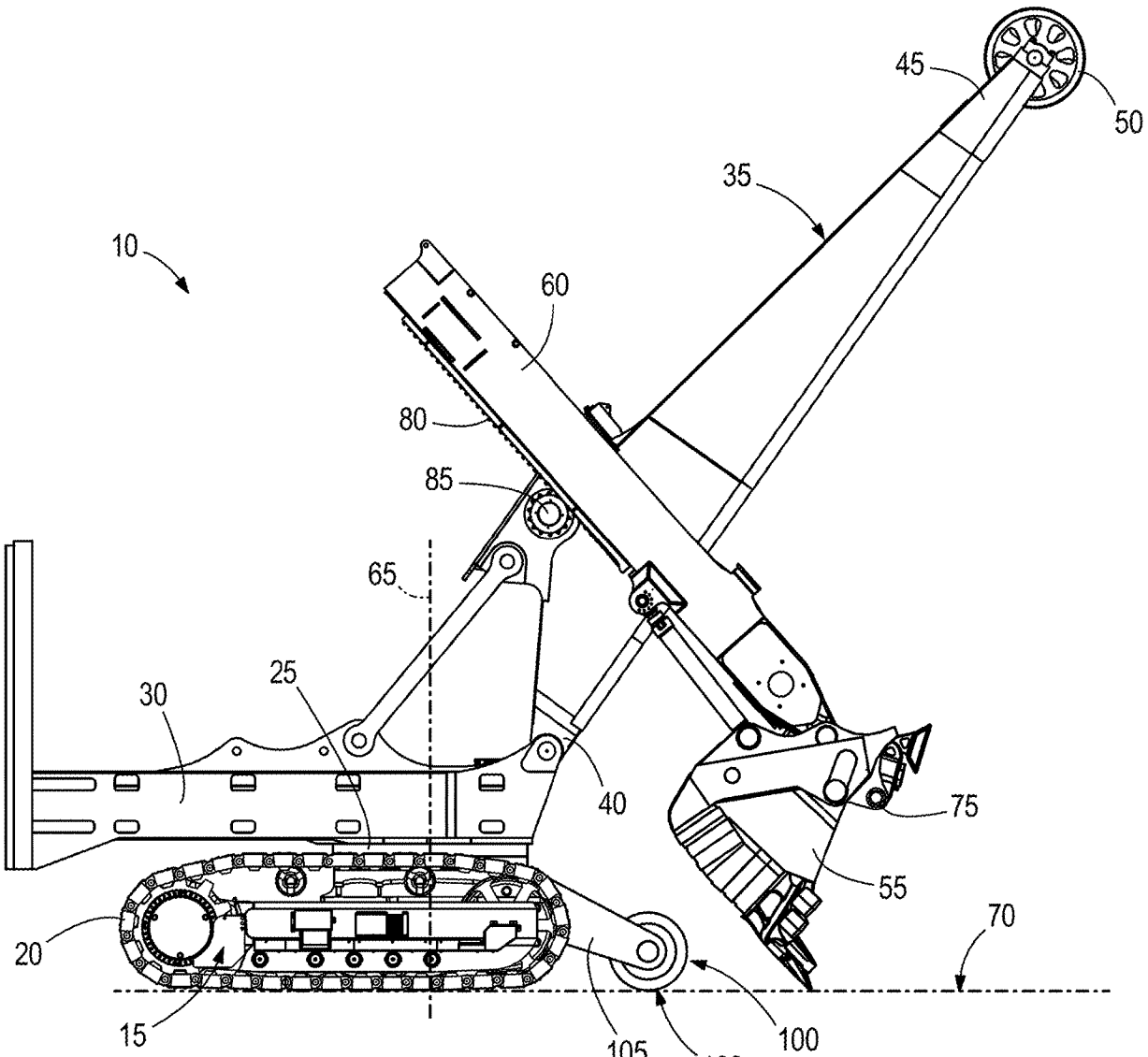
FIG. 1 is a perspective view of a mining shovel, illustrating a shovel stabilizer appendage.
Figure 2:
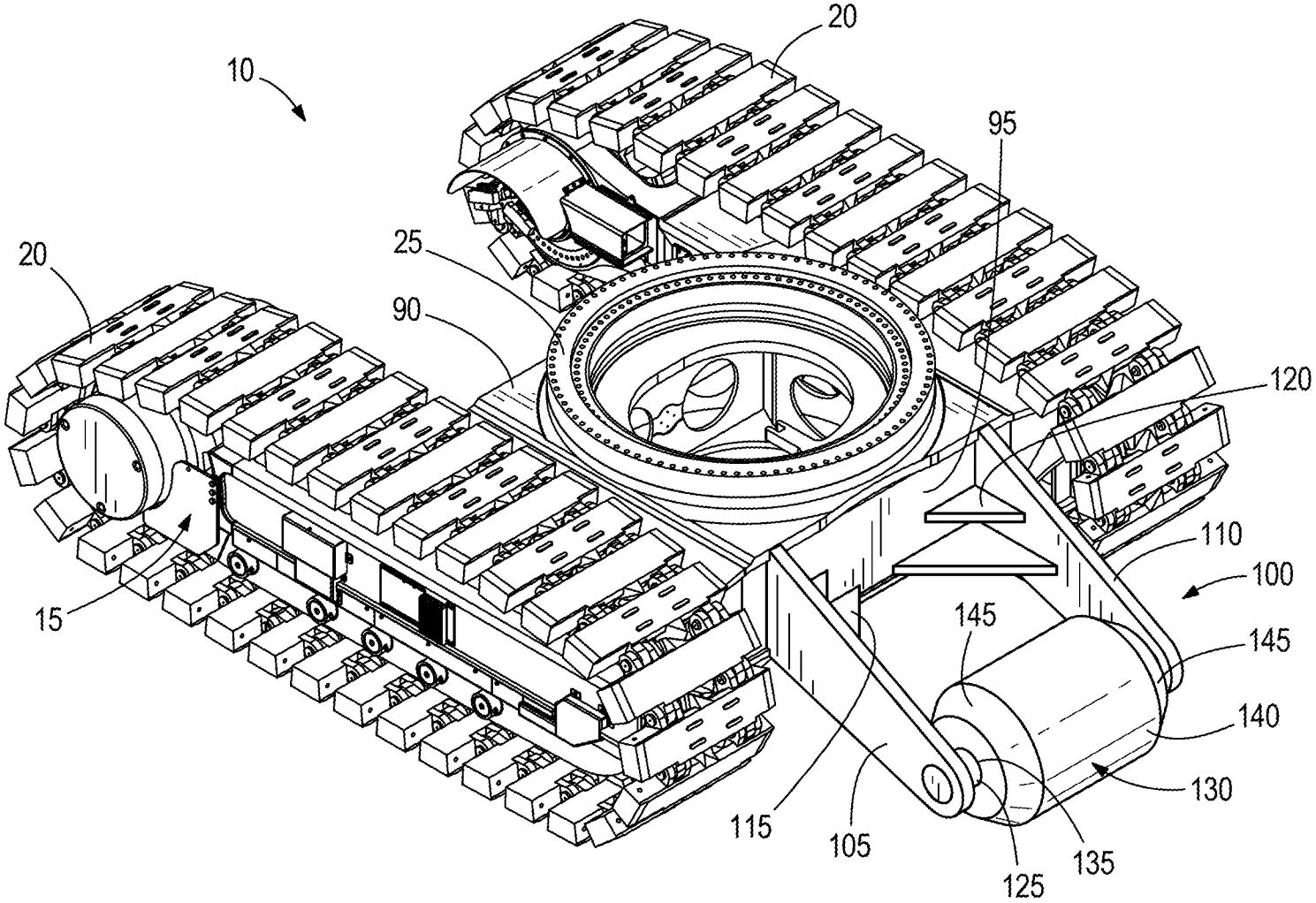
FIG. 2 is a perspective view of a lower portion of the mining shovel of FIG. 1.

FIGS. 1 and 2 illustrate a mining shovel 10. The mining shovel 10 includes a mobile base 15, drive tracks 20 (e.g., crawler tracks) coupled to the mobile base 15, a turntable 25 coupled to the mobile base 15, a frame 30 coupled to the turntable 25, and a boom 35 coupled to the frame 30. The boom 35 includes a lower end 40 (also called a boom foot) and an upper end 45 (also called a boom point). A sheave 50 is rotatably mounted on the upper end 45 of the boom 35. The mining shovel 10 further includes a dipper 55, and a dipper handle 60. As illustrated in FIG. 1, the frame 30, as well as the boom 35, the dipper 55, and the dipper handle 60 rotate relative to the drive tracks 20 about a rotational axis 65 defined by the turntable 25. The rotational axis 65 is perpendicular to a plane 70 defined by the mobile base 15 and the drive tracks 20 and generally corresponding to a grade of a ground or support surface.

The mobile base 15 is supported by the drive tracks 20. The mobile base 15 supports the turntable 25 and the frame 30. The turntable 25 is capable of 360-degrees of rotation relative to the mobile base 15. The boom 35 is pivotally connected at the lower end 40 to the frame 30. In some constructions, the boom 35 is held in an upwardly and outwardly extending relation to the frame 30 by tension cables (not shown), which are anchored to a gantry tension member and a gantry compression member, the gantry compression member being mounted on the frame 30.

In some constructions, the dipper 55 is suspended from the boom 35 by a hoist rope wrapped over the sheave 50 and attached to the dipper 55 via a bail connection point 75 and bail (not shown). The hoist rope may be anchored to a winch drum (not shown) of the revolving frame 30. The winch drum may be driven by at least one electric motor (not shown) that incorporates a transmission unit. As the winch drum rotates, the hoist rope is paid out to lower the dipper 55 or pulled in to raise the dipper 55. The dipper handle 60 is coupled to the dipper 55. The dipper handle 60 may be slidably supported in a saddle block, and the saddle block may be pivotally mounted to the boom 35 at a shipper shaft. The dipper handle 60 includes a rack and tooth formation 80 thereon that engages a drive pinion 85 (e.g., mounted within the saddle block to the boom 35). The drive pinion 85 is driven by an electric motor and transmission unit (not shown) to extend or retract the dipper handle 60.

In some constructions, an electrical power source (not shown) is mounted to the frame 30 to provide power to a hoist electric motor (not shown) for driving the winch drum, one or more crowd electric motors (not shown) for driving a crowd transmission unit (e.g., for extending or retracting the dipper handle 60), and one or more swing electric motors (not shown) for turning the frame 30 about the base 15. Each of the crowd, hoist, and swing motors is driven by its own motor controller, or is alternatively driven in response to control signals from a controller (not shown).

Referring to FIG. 2, the mobile base 15 of the mining shovel 10 includes a carbody 90 that extends between the drive tracks 20. The carbody 90 includes the turntable 25, as well as a front end 95 (e.g., a wall) that faces in a direction of forward movement of the mining shovel 10. The mining shovel 10 also includes a shovel stabilizer appendage 100. In the illustrated construction, the stabilizer appendage 100 extends from the front end 95 of the carbody 90 in the direction of forward movement. The stabilizer appendage 100 provides stabilizing support to the mining shovel 10 during at least a digging operation (e.g., when the dipper 55 is being used to dig through a bank of material and/or to raise or otherwise move material).

In the illustrated construction, the stabilizer appendage 100 includes a first stabilizer frame 105 coupled to (e.g., fixed via welding or integrally formed as a single piece with) the front end 95 of the carbody 90. The stabilizer appendage 100 further includes a second stabilizer frame 110 coupled to the front end 95 of the carbody 90. The first stabilizer frame 105 and the second stabilizer frame 110 extend parallel to one another, and each extend perpendicularly from the front end 95 of the carbody 90. The stabilizer appendage 100 further includes a first support rib 115 fixed to both the first stabilizer frame 105 and the front end 95 of the carbody 90, and a second support rib 120 fixed to both the second stabilizer frame 110 and the front end 95 of the carbody 90. The first and second support ribs 115, 120 each have a generally triangular shape. Other constructions include various other shapes, sizes, numbers, and arrangements of stabilizer frames and/or support ribs than that shown. For example, in some constructions the stabilizer appendage 100 includes a single stabilizer frame fixed to the front end 95 of the carbody. In some constructions, the stabilizer appendage 100 does not include any support ribs. In some constructions, the stabilizer appendage 100 includes stabilizer frames that do not extend parallel to one another (e.g., extend toward one another at an oblique angle). In some constructions, the stabilizer appendage 100 is releasably coupled to the carbody 90.

Referring to FIGS. 1 and 2, in the illustrated construction, the stabilizer appendage 100 includes a bearing element 125 (e.g., a pin, bushing, and/or other bearing structure) that extends between the first stabilizer frame 105 and the second stabilizer frame 110, and a roller 130 (e.g., a barrel) coupled to the bearing element 125 for rotation about the bearing element 125. Other constructions include other structures in place of or in addition to the roller 130 (e.g., a plate or plates, etc.). In the illustrated construction, the bearing element 125 is a fixed cylindrical rod that extends entirely through an aperture 135 of the roller 130. The roller 130 has a generally cylindrical shape, with a main outer surface 140 and two chamfered surfaces 145 on either side of the main outer surface 140. During a digging operation (e.g., when the mining shovel 10 is stationary, the drive tracks 20 are not in operation, and the dipper 55 is being used to dig through a bank of material) the main outer surface 140 contacts the ground or support surface, and provides a counterbalance support to the mining shovel 10 (see FIG. 1). During a propel operation (e.g., when the drive tracks 20 are in operation and the mining shovel 10 is moving), the main outer surface 140 rides and/or rolls over the ground or support surface (e.g., including over rocks or debris). The chamfered surfaces 145 on the roller 130 facilitate pushing or otherwise moving material out of the way of the roller 130 and the stabilizer appendage 100 as the mining shovel 10 moves forward, backwards, or in other directions. Other constructions include various other shapes, sizes, numbers, and arrangements of bearing elements and rollers than that shown are provided. For example, in some constructions two bearing elements 125 are provided, each extending into a portion of the roller 130. In some constructions, the bearing elements 125 are fixed to and extend axially from opposite ends of the roller 130, and are received in bearing openings in the first and second stabilizer frames 105, 110. In some constructions, the roller 130 does not include the two chamfered surfaces 145.

The stabilizer appendage 100 provides stabilizing support (e.g., counterbalance support) to the mining shovel 10 during at least a digging operation. The stabilizer appendage 100 absorbs tipping forces as the mining shovel 10 begins (or attempts) to tip forward (e.g., due to moment forces generated by the dipper 55 digging into a bank of material and/or trying to lift and move material, or due to the mining shovel 10 forward digging on a down grade slope). The roller 130 experiences pressure as it is pressed into the ground or support surface. The higher the pressure on the roller 130, the more the roller 130 may sink into the ground or support surface (e.g., soft earth), thus increasing an overall footprint for interface of the roller 130 with the ground surface, and lowering a peak dynamic ground bearing pressure. Dynamic ground bearing pressure refers to a maximum pressure value reached when the mining shovel is digging and tipping forward (e.g., a pressure value at a front of the mining machine 10 that is absorbing a majority of the tipping, such as at the roller 130). Conversely, ground bearing pressure refers to the mining shovel 10 weight divided by a contact or interference area between the crawler shoes and the ground or support surface. Reduction of both dynamic ground bearing pressure and ground bearing pressure is desirable so that the mining machine 10 does not overly rock back and forth during digging (affecting user comfort), and so that the mining machine 10 does not overly dig itself into ruts in the ground or support surface that are difficult to maneuver or propel out of.

Figure 3:
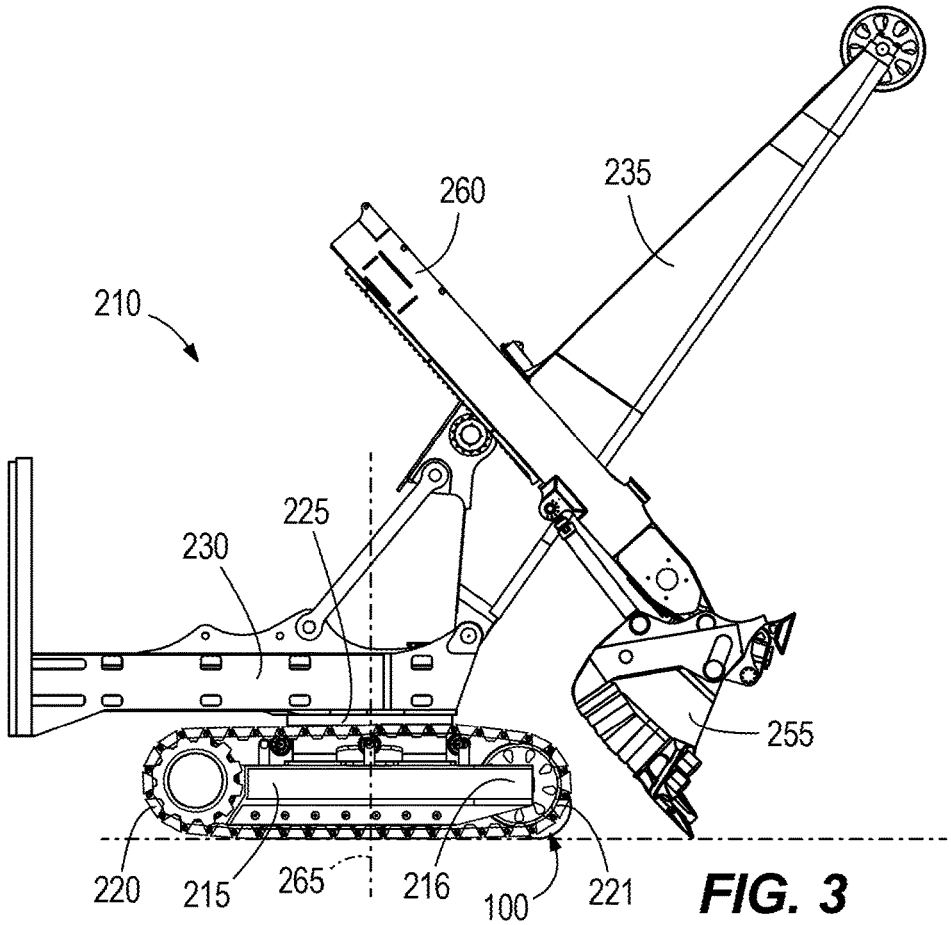
FIG. 3 is a side view of a mining shovel according to a different construction.

FIG. 3 illustrates a mining shovel 210. The mining shovel 210 includes a mobile base 215, drive tracks 220 coupled to the mobile base 215, a turntable 225 coupled to the mobile base 215, a frame 230 coupled to the turntable 225, a boom 235 coupled to the frame 230, a dipper 255, and a dipper handle 260. The frame 230, as well as the dipper 255 and the dipper handle 260, rotate about a rotational axis 265 defined by the turntable 225. As illustrated in FIG. 3, the drive tracks 220 extend further forward toward the dipper 255, such that a front end 221 of the drive tracks 220, as well as a front end 216 of the mobile base 215 (e.g., including idler rollers) absorb all or substantially all of the tipping forces generated during a digging operation. As illustrated in FIG. 3, in this arrangement the axis of rotation 265 is positioned generally through (or exactly through) a center of the mobile base 215 and the drive tracks 220, such that one half or approximately one half of the mobile base 215 and the drive tracks 220 is disposed on one side of the axis 265, and the other half or approximately the other half of the mobile base 215 and the drive tracks 220 is disposed on the opposite side of the axis 265. As illustrated in FIG. 3, the front end 221 of the drive tracks 220 extends well past a front end of the frame 230. In contrast, and referring to FIG. 4 (which illustrates the shovel 10 from FIGS. 1 and 2), the drive tracks 20 do not extend as far forward as the drive tracks 220 in FIG. 3. Rather, a front end 21 of the drive tracks 20 extends only to or slightly past a front end of the frame 30. In this arrangement, the stabilizer appendage 100 absorbs all or significantly all of the tipping forces. Additionally, in this arrangement the axis of rotation 65 is positioned through the mobile base 15 and the drive tracks 20 such that a larger portion (e.g., at least 55%, at least 60%, at least 65%, at least 70%, at least 75%, at least 80%) of the mobile base 15 and the drive tracks 20 is disposed on one side of the axis of rotation 65 (i.e., on a rearward side) than on the other side of the axis of rotation 65. The idler rollers at the front end 21 of the drive tracks 20 may thus be made lighter (lower weight and cost) than those of the mining machine 210, because the idler gears and the front end 21 of the drive tracks 20 are not relied upon to absorb significant tipping forces.

Figure 4:
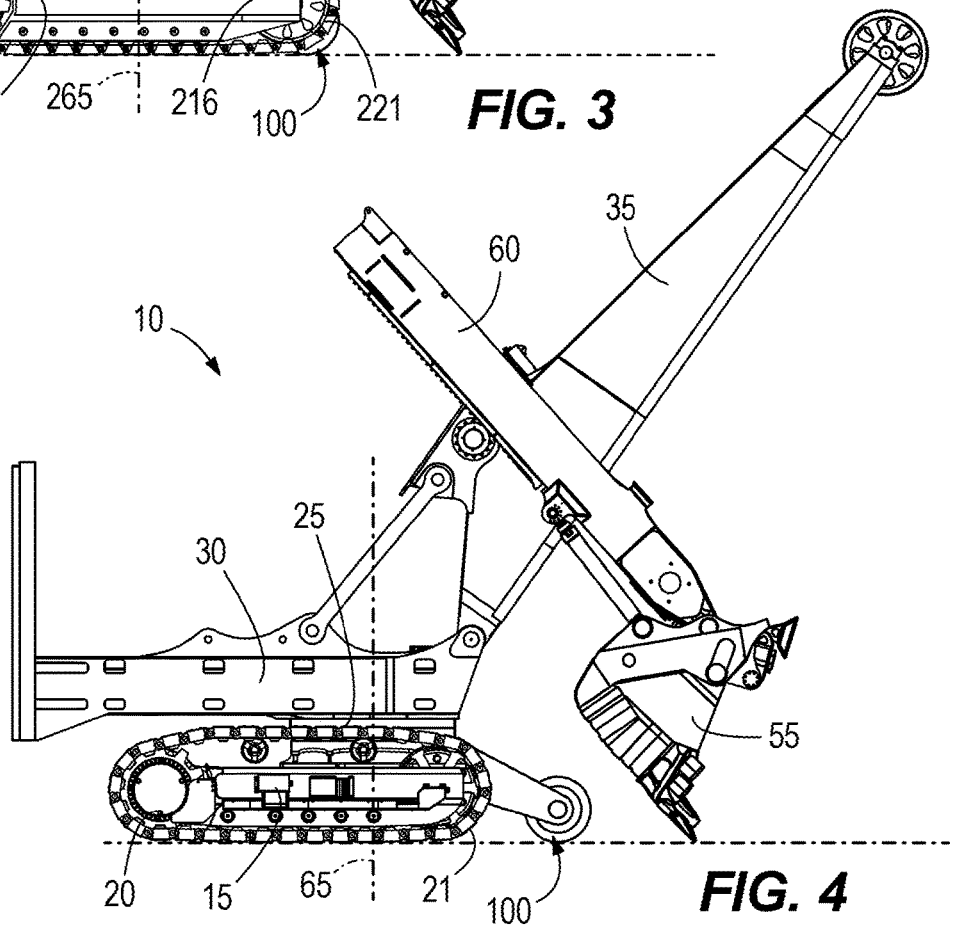
FIG. 4 is a side view of the mining shovel of FIG. 1, as a comparison to FIG. 3.
Figure 5:
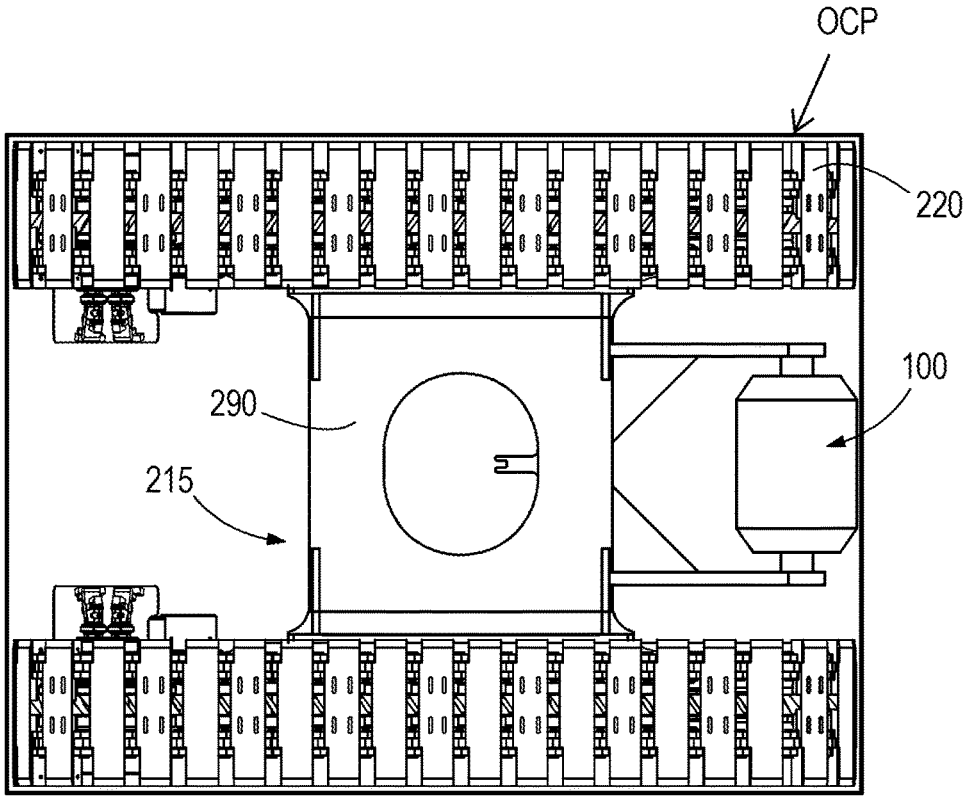
FIGS. 5-7 are top views of a portion of the mining shovel of FIG. 1, illustrating a changing crawler profile.
Figure 6:
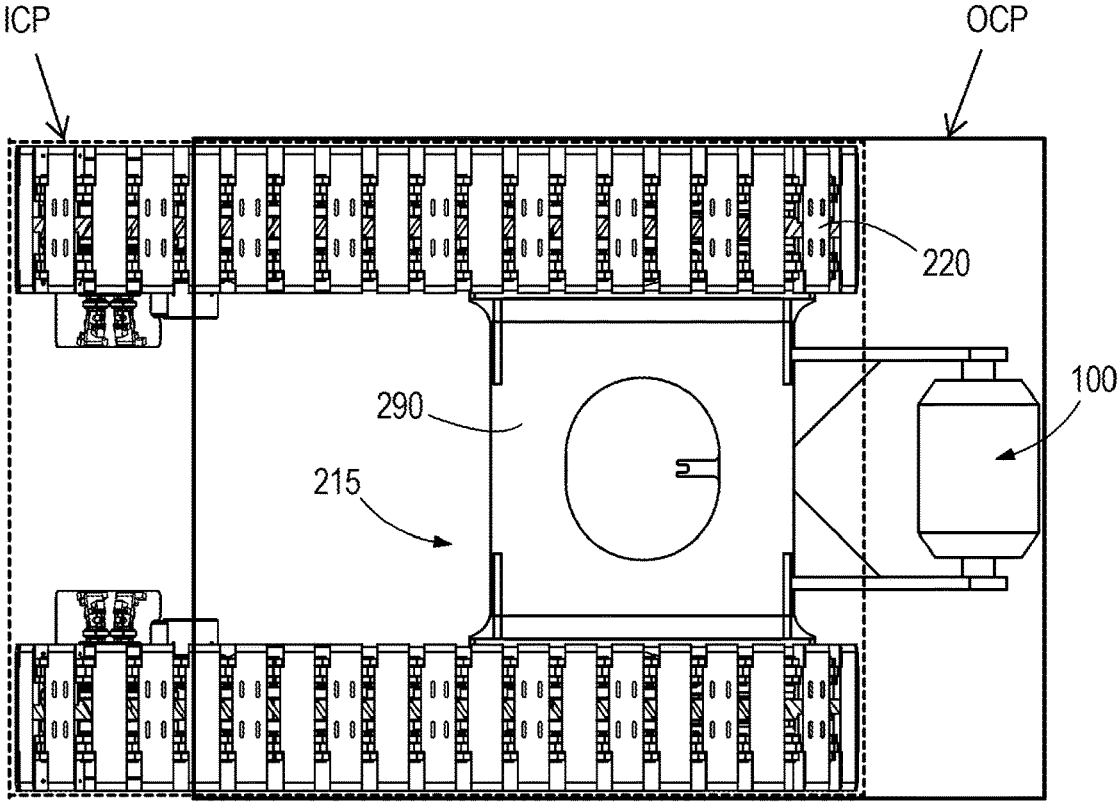
Figure 7:
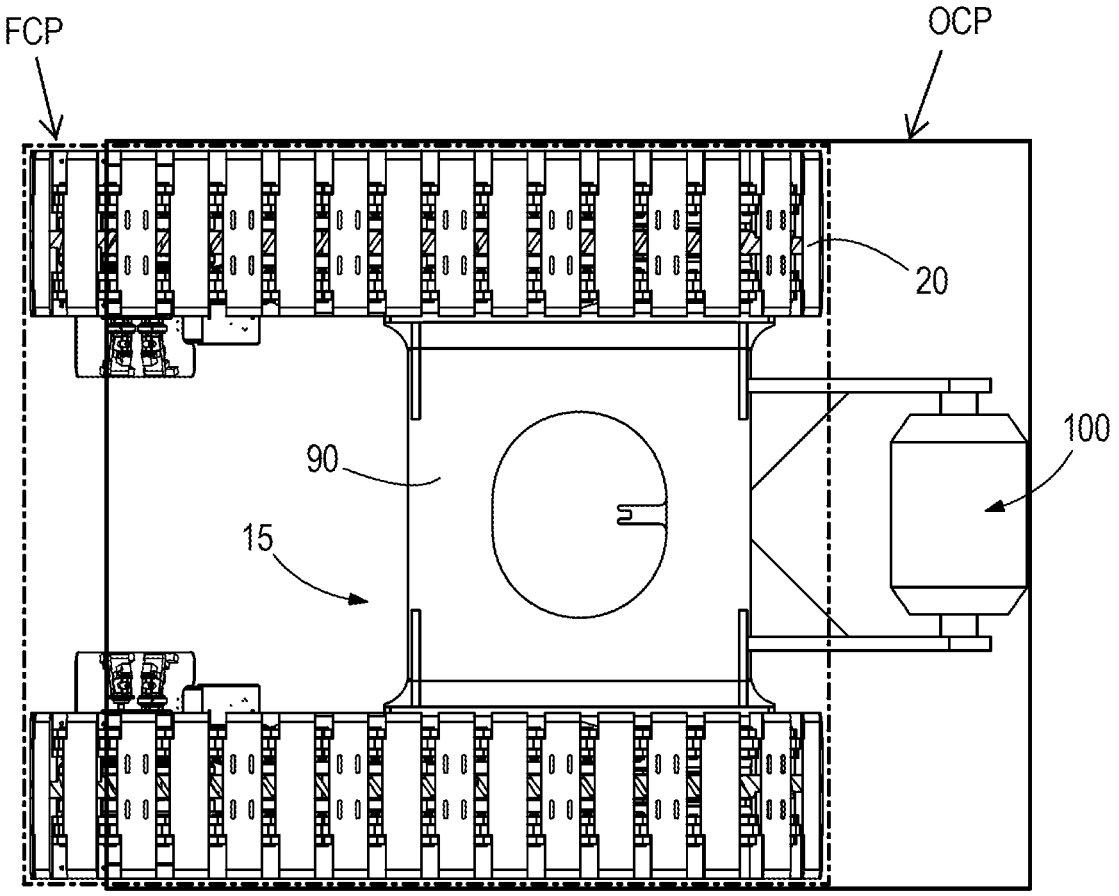

FIGS. 5-7 further illustrate how use of the stabilizer appendage 100 permits a change in the size and shape of a mobile base and drive tracks of a mining machine. For example, FIG. 5 illustrates the mobile base 215 and the drive tracks 220 from FIG. 3, with the stabilizer appendage 100 added for illustrative purposes and coupled to a carbody 290 of the mobile base 215. An "Original crawler profile" OCP is marked to demonstrate a perimeter of the drive tracks 220. FIG. 6 illustrates a rearward shift in the design of the drive tracks 220, such that the carbody 290 and the stabilizer appendage 100 remain in place, but the profile of the drive tracks 220 themselves has moved rearward to an "Intermediate crawler profile" ICP position. FIG. 7 illustrates a shortening in the design of the drive tracks 220 as compared to FIG. 6, such that the drive tracks 220 are transformed into the drive tracks 20 illustrated in FIG. 4, and a resulting "Final crawler profile" FCP is obtained, including a finalized mobile base 15 and carbody 90 as seen in FIG. 4. The finalized crawler profile has a square, or nearly square, appearance when viewed along a vertical direction (as compared with the more elongated rectangular appearance of the original crawler profile). In some embodiments, this final, square profile improves shovel steer-ability as the steering torque needed to differential steer (one crawler travels faster than the other) or counter-rotate (crawlers travel in opposite direction) steer the shovel. That is, changing the crawler profile from rectangular to square allows for a more efficient profile to steer with as the propel torque needed to steer goes down. There may therefore be a steering advantage/benefit that may be provided with the new square profile. In some embodiments, the finalized crawler profile has a length to width ratio of between 0.95 and 1.05, or between 0.9 and 1.1, or between 0.8 and 1.2, the length being measured a direction between a front end of the mining shovel 10 and a rear end of the mining shovel 10 and along a direction corresponding to movement of the drive tracks 20. As illustrated in FIGS. 5-7, the width of the profile generally does not change between the mining shovel 210 and the mining shovel 10. Rather, only the length. Other constructions include different shapes and dimensions (including ratios of dimensions) than that illustrated.

Referring to FIGS. 4-7, and as described above, the drive tracks 20 of the mining machine 10 are shorter in length than the drive tracks 220 of the mining machine 210. Additionally, in contrast to the mining machine 210, the mining machine 10 does not rely on the front ends 21 of the drive tracks 20 themselves, or on the front ends of the mobile base 15, and/or on bolted interfaces in the mobile base 15, to absorb significant tipping loads. In the mining machine 210, these tipping loads create tortuous load flow pathways, and may require heavy robust structures to absorb the loads. In contrast, in the mining machine 10 the tipping loads flow directly into the carbody 90 via the stabilizer appendage 100. This direct load flow permits the carbody 90 to be made with less material and/or lighter material than in the mining machine 10, thereby reducing costs.

Figure 8:
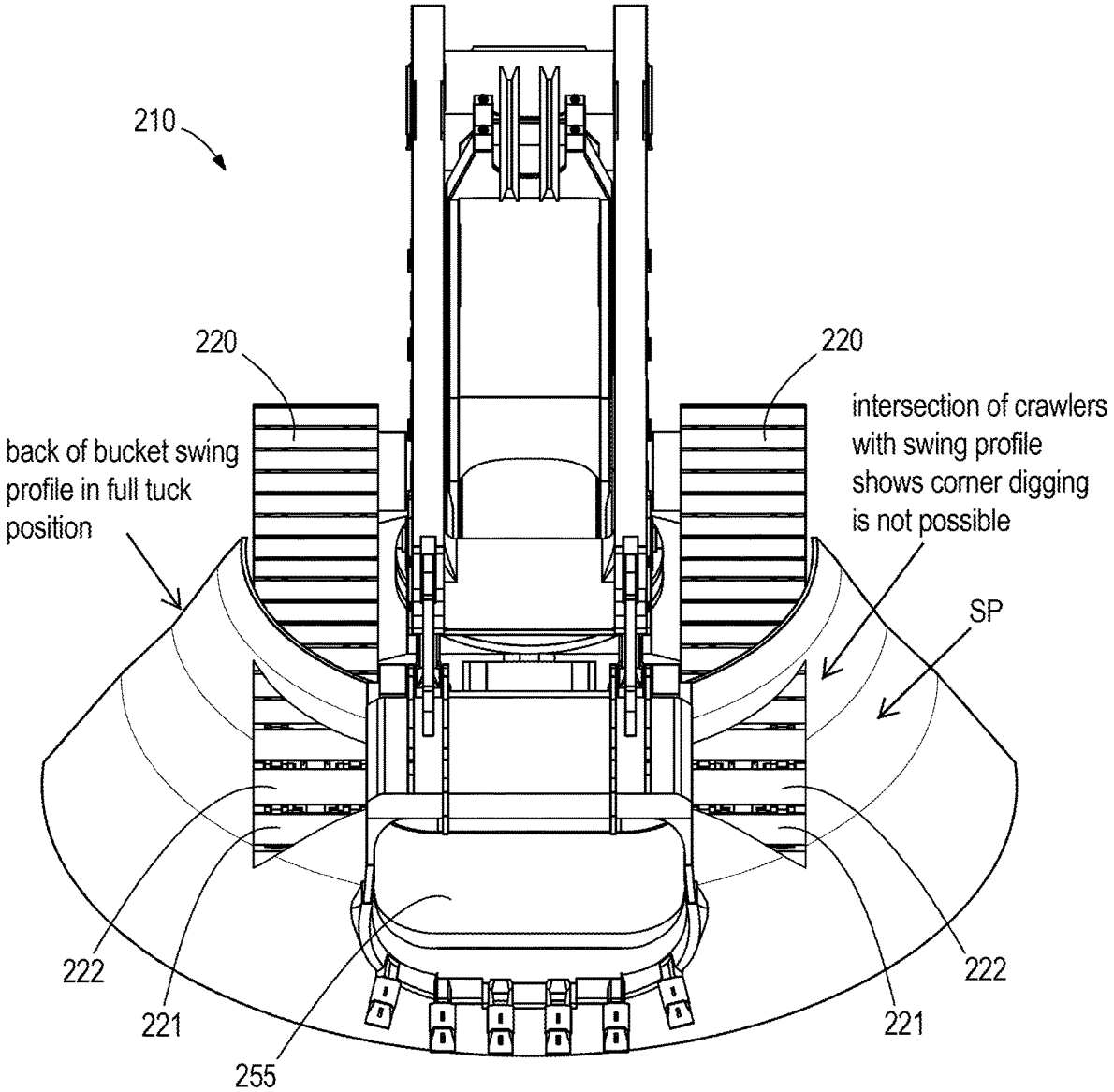
FIG. 8 is a schematic representation of the mining shovel of FIG. 3, illustrating a limited swing profile of a dipper.
Figure 9:
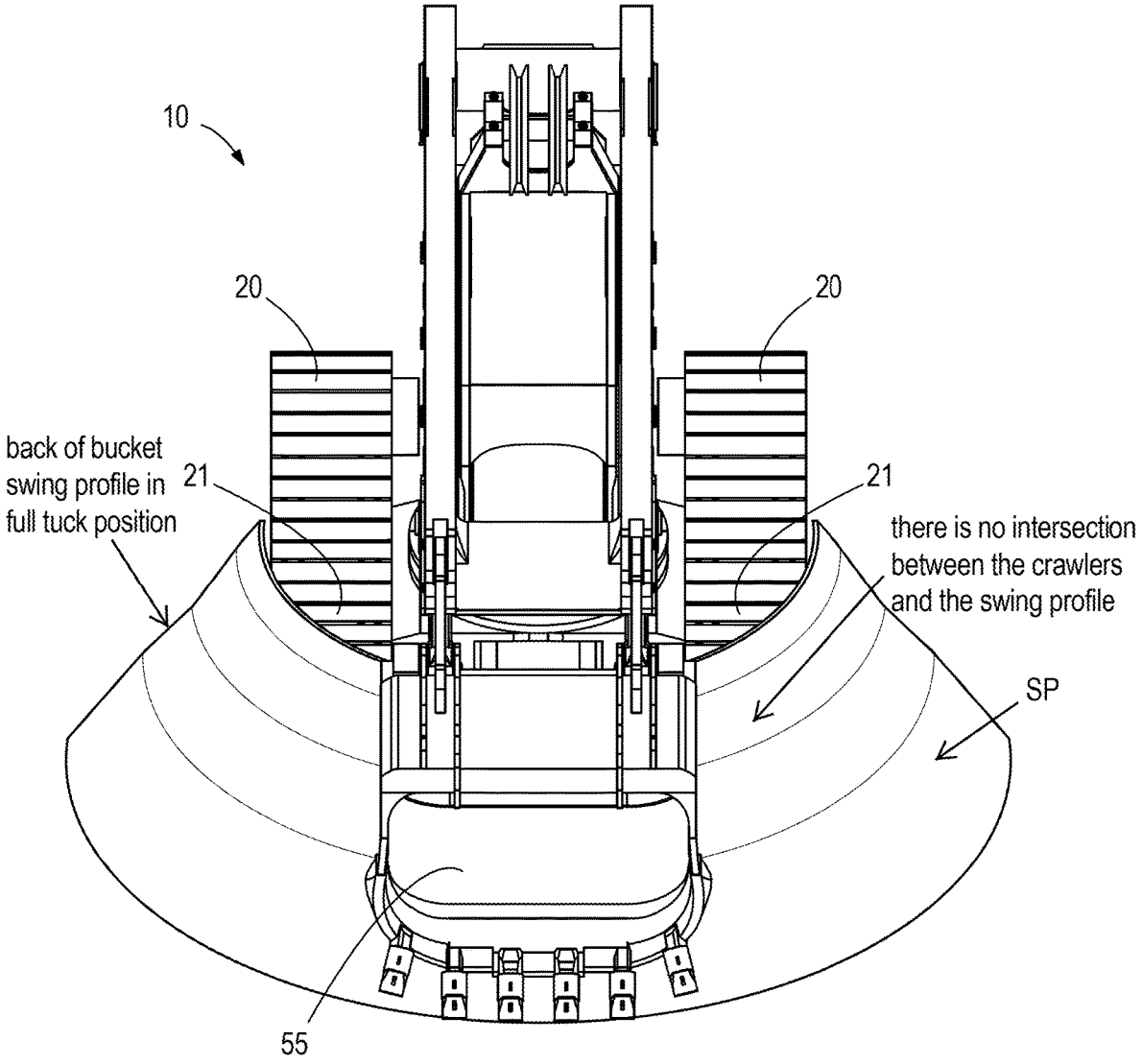
FIG. 9 is a schematic representation of the mining shovel of FIG. 1, illustrating a more expansive swing profile of the dipper.
Figure 11:
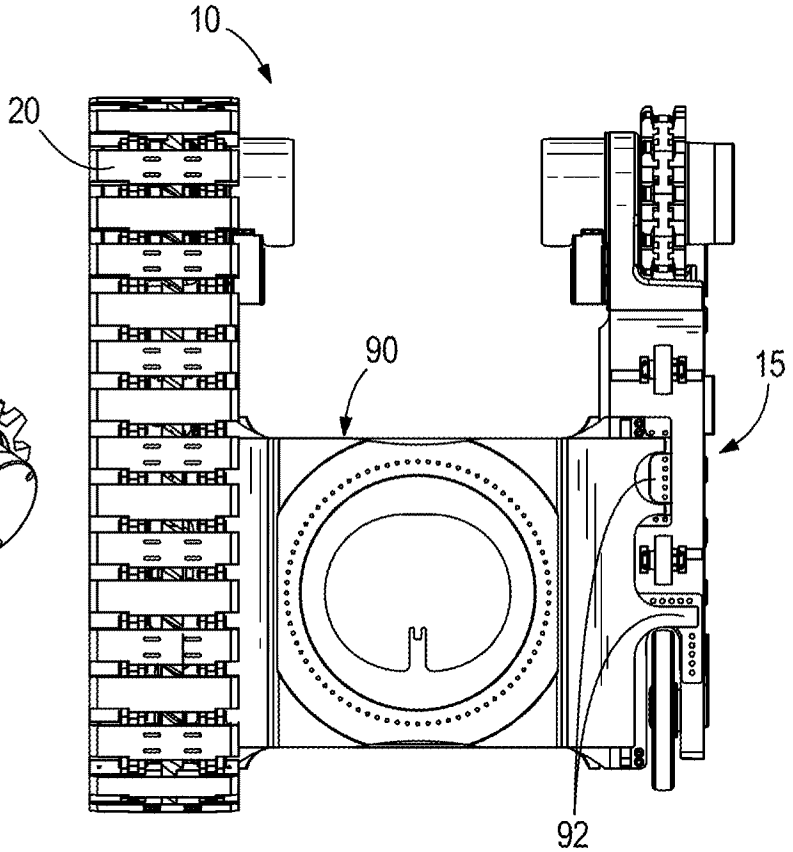
FIGS. 10 and 11 are perspective and top views, respectively, of a carbody for the mining shovel of FIG. 1 before the carbody is swept back for clearance of drive tracks.
Figure 10:
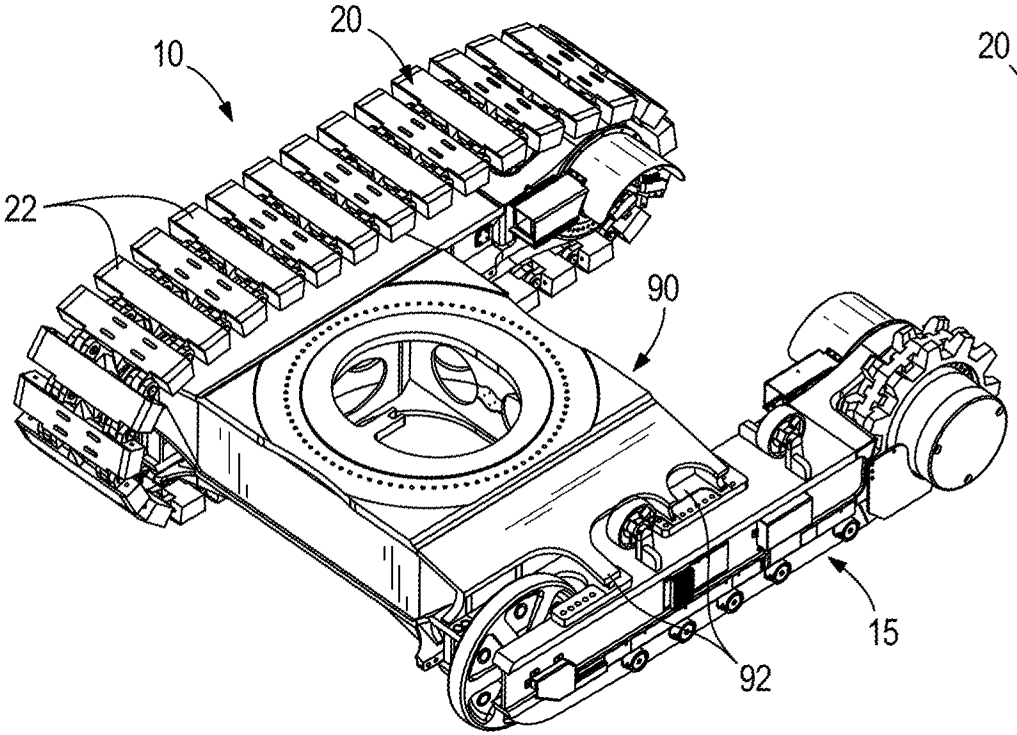
Figure 13:
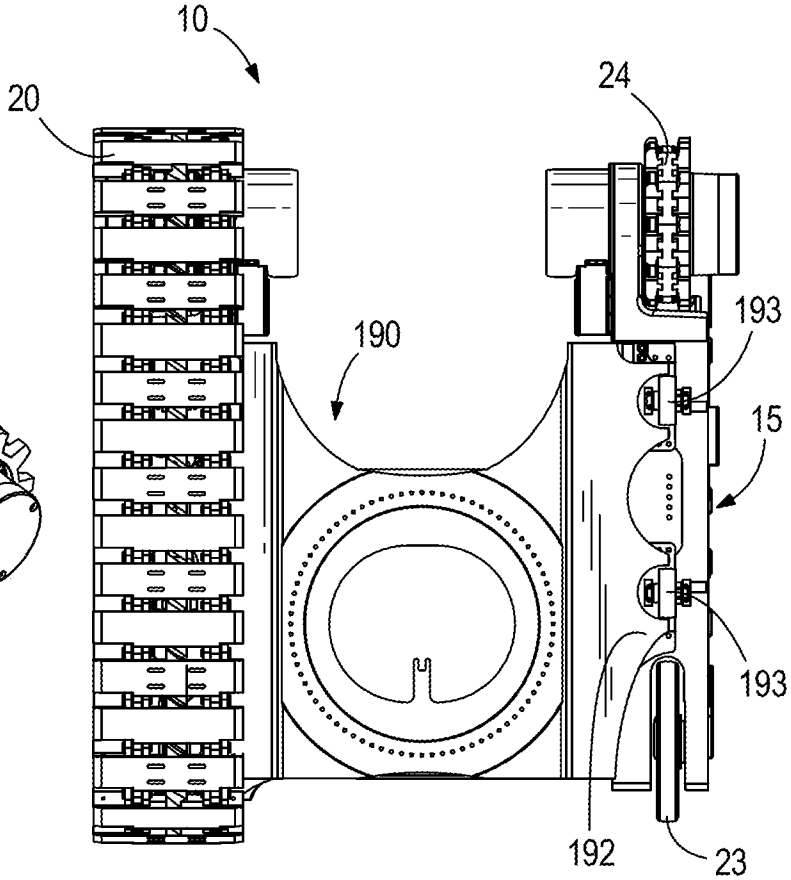
FIGS. 12-15 are perspective and top views, respectively, of the carbody after being swept back for clearance of the drive tracks.
Figure 12:
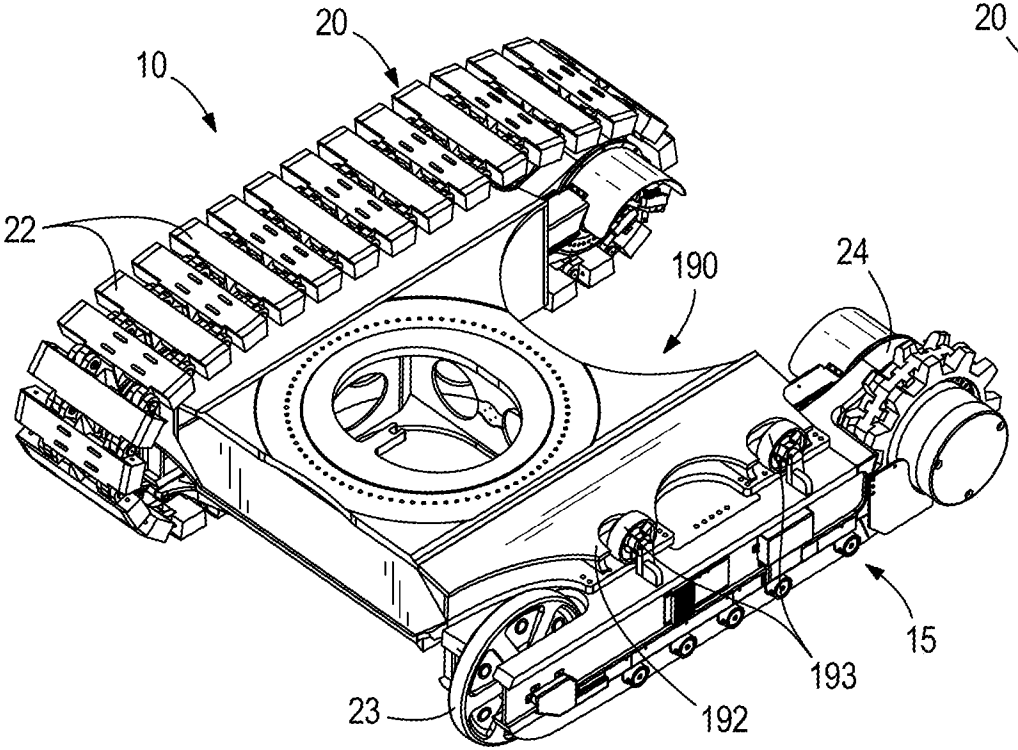
Figure 15:
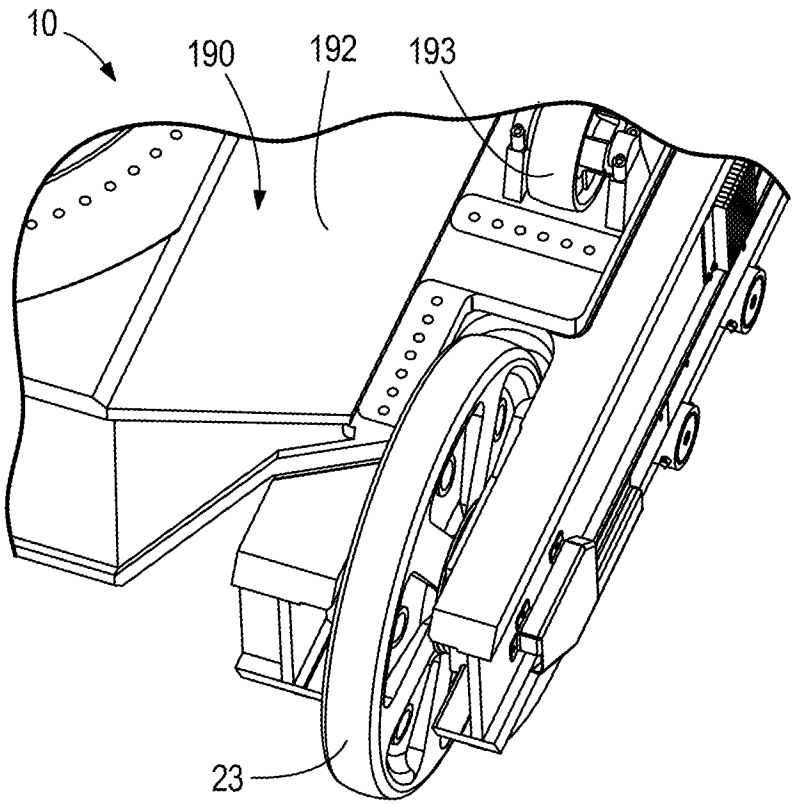

Referring to FIGS. 8 and 9, the shift in drive track location accommodated by the use of the stabilizer appendage 100 provides additional benefits. For example, FIG. 8 illustrates a frontal view of the mining shovel 210 from FIG. 3, showing a relative position of the drive tracks 220 and the dipper 255. As illustrated in FIG. 8, the dipper 255 is limited in its ability to swing laterally (i.e., generally to the left and right in FIG. 8 in an arcuate manner) through a swing profile SP when the dipper 255 is in a fully tucked position (i.e., when the dipper 255 is pulled back toward a rear of the mining machine 210). The front ends 221 of the drive tracks 220 are positioned far enough forward to accommodate tipping forces of the mining machine 210. However, the front ends 221 of the drive tracks 220 intersect the illustrated swing profile SP at intersecting regions 222 along the drive track 220, and impede further lateral movement of the dipper 255 along its swing path (e.g., creating collision between the dipper 255 and shoes of the drive tracks 220).

In contrast, FIG. 9 illustrates a frontal view of the mining shovel 10. As illustrated in FIG. 9, the dipper 55 is no longer limited in its ability to swing laterally (i.e., generally to the left and right in FIG. 9 in an arcuate manner) through the swing profile SP when the dipper 55 is in the fully tucked position (i.e., when the dipper 55 is pulled back toward a rear of the mining machine 10). The front ends 21 of the drive tracks 20 are positioned far enough rearward so that the front ends 21 do not intersect the illustrated swing profile and do not impede further lateral movement of the dipper 55. This arrangement permits the dipper 55 to swing fully through its swing profile SP, and to be used to move material and/or to be used for other purposes when in the fully tucked position. In some constructions, this arrangement of the drive tracks 20 additionally reduces or eliminates the need for software to track positioning of the dipper 55, allows digging to begin while physically positioning the mining shovel 10 much closer to a bank of material (e.g., to dig and prep a floor at the base of a bank of material), allows for more voluminous removal of bank material while reducing a frequency needed to propel and re-position the mining shovel 10 (i.e., creating greater efficiency and productivity), and/or provides reduction in counterweight load due to the added stability provided by the stabilizer appendage 100.

In some constructions, the stabilizer appendage 100 may be added without modification and/or repositioning of the drive tracks. For example, and as illustrated in FIG. 3, in some constructions the stabilizer appendage 100 is included with the drive tracks 220 (a small portion of a stabilizer appendage 100 being visible in FIG. 3), and the drive tracks 220 are not modified and/or repositioned into the drive tracks 20 illustrated in FIG. 4. In these constructions, the stabilizer appendage 100 may be used in a bog or other soft ground material to keep the shovel from sinking and/or digging a rut.

In yet additional constructions, the stabilizer appendage 100 may extend even farther forward and/or laterally outward than shown in FIGS. 4 and 7, so long as the appendage 100 (e.g., the roller portion or skid plate portion) does not interfere with a fully tucked back bucket).

Figure 14:
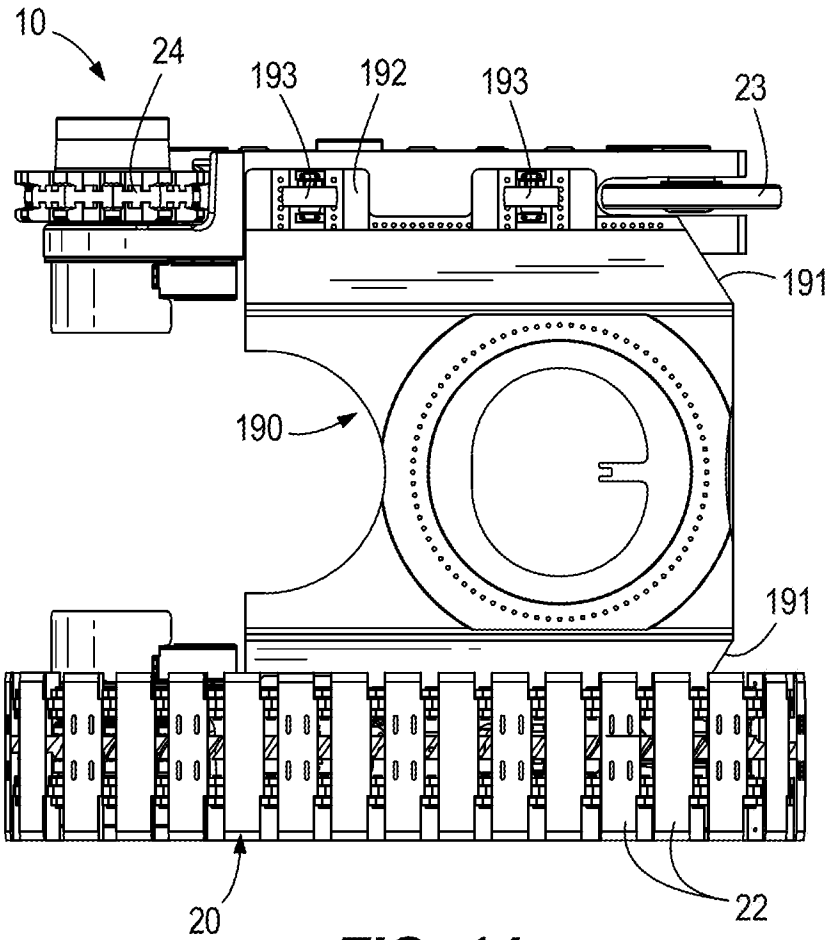

Referring to FIGS. 10-15, the mobile base 15, including its carbody, may come in a variety of different shapes, sizes, and forms. For example, referring to FIGS. 12-15, a carbody 190 may have a generally swept-back profile (e.g., including chamfers or other angled edges 191 as illustrated in FIG. 14) to accommodate roller shoe 22 clearance so that as the roller shoes 22 rotate around a front idler 23 on their way back to a rear tumbler 24 (and vice versa) they do not interfere with the carbody 90 (as would be the case in FIGS. 10 and 11). The profile in FIGS. 12-15 also allows for shear ledge and bolted connections, different for example than connections found on the mining shovel 10 of FIG. 3. For example, as illustrated in FIGS. 12-15, a shear ledge 192 on the carbody 190 may form part of the mobile base 15 that supports the drive tracks 20. Referring to FIGS. 12-15, in some constructions upper rollers 193 for the roller shoes 22 are mounted on the shear ledge 192 itself. Other constructions include various other profiles for a carbody 90, 190 than that illustrated.

FIGS. 16-25 illustrate a portion of a mining shovel 410. The mining shovel 410 includes a mobile base 415, drive tracks 420 coupled to the mobile base 415, and a turntable 425 coupled to the mobile base 415. The turntable 425 defines a rotational axis 465 (FIG. 17) for rotation of a frame (not shown), boom (not shown), dipper (not shown), and dipper handle (not shown).

The mobile base 415 of the mining shovel 410 includes a carbody 490 that extends between the drive tracks 420. The carbody 490 includes the turntable 425, as well as a front end 495 (e.g., a wall) that faces in a direction of forward movement of the mining shovel 410. The mining shovel 410 also includes a shovel stabilizer appendage 500. In the illustrated construction, the stabilizer appendage 500 extends from the front end 495 of the carbody 490. The stabilizer appendage 500 provides stabilizing support to the mining shovel 410 during at least a digging operation (e.g., when the dipper is being used to dig through a bank of material and/or to raise or otherwise move material).

Figure 16:
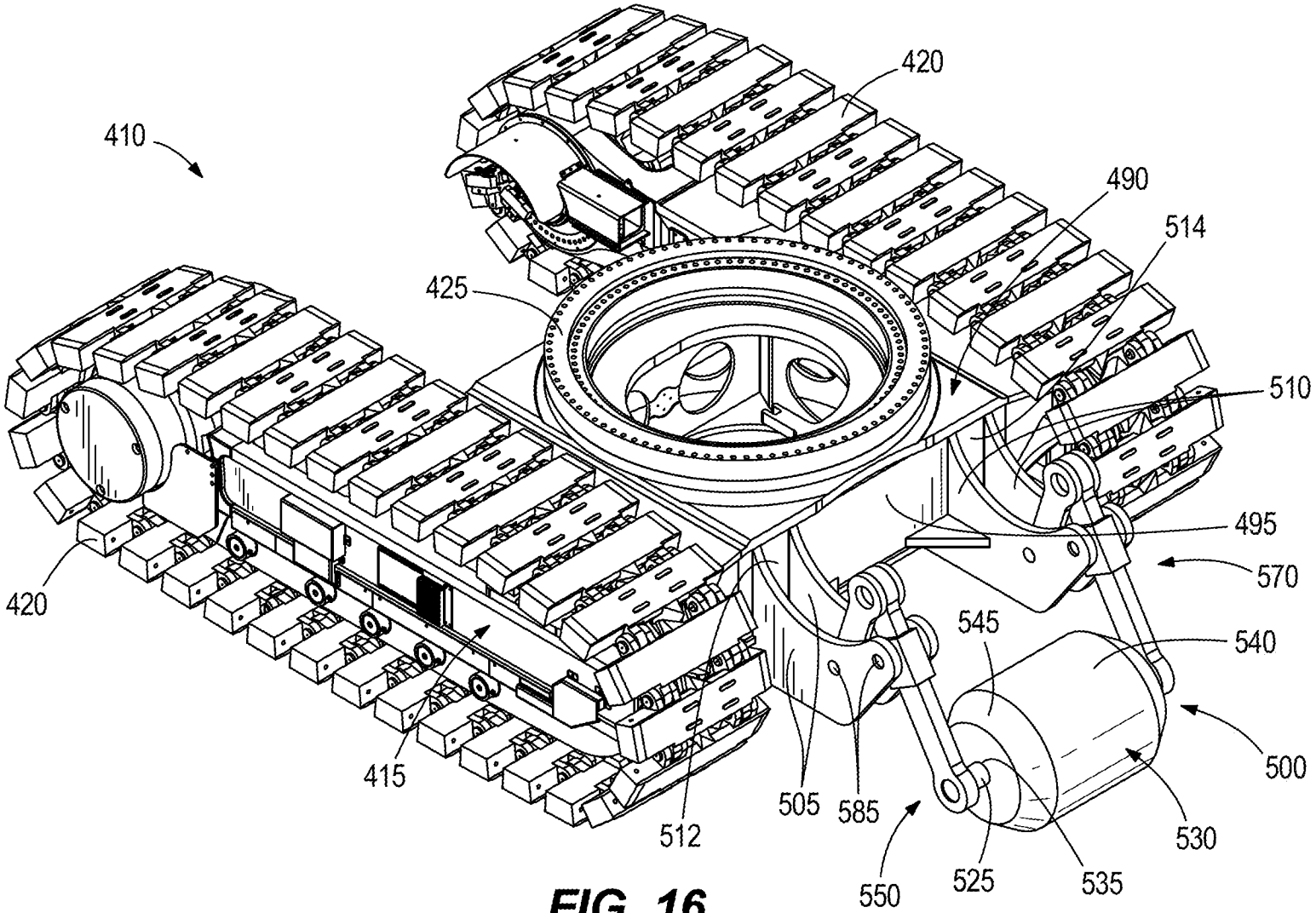
FIGS. 16-20 are perspective, side, and bottom views of a shovel stabilizer appendage according to another construction, with the stabilizer appendage in a digging position.
Figure 17:
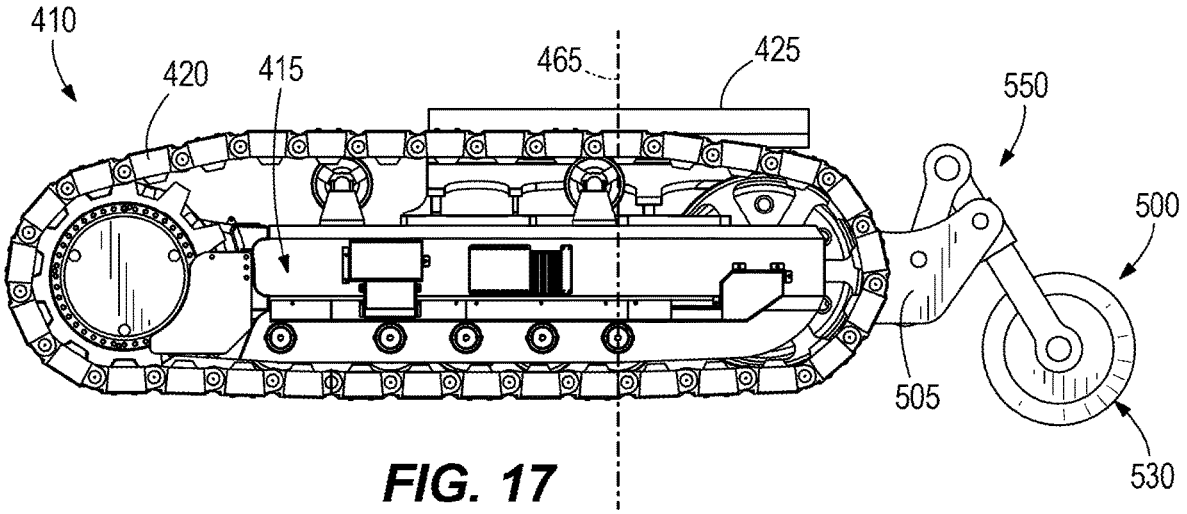
Figure 18:
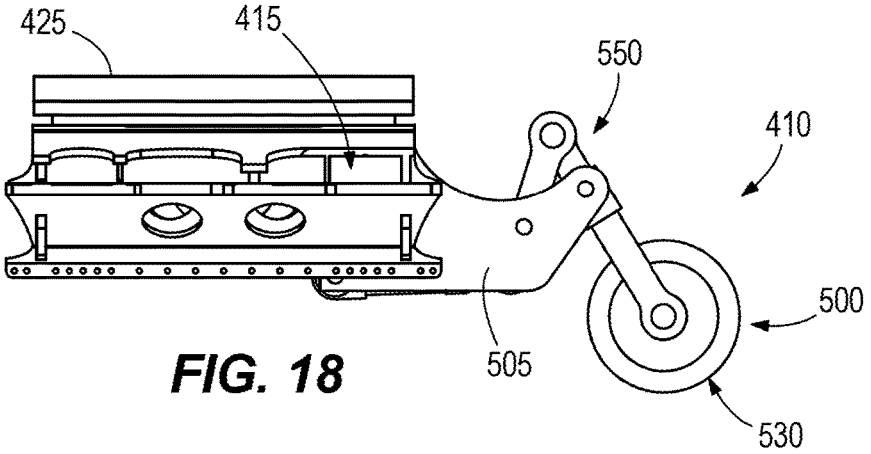

The stabilizer appendage 500 includes a set of first stabilizer frames 505 coupled (e.g., via welding or being integrally formed as a single piece with) to the front end 495 of the carbody 490. The stabilizer appendage 500 further includes a set of second stabilizer frames 510 coupled to the front end 495 of the carbody 490. The first stabilizer frames 505 and the second stabilizer frames 510 extend parallel to one another, and each extend perpendicularly from the front end 495 of the carbody 490. As illustrated in FIG. 16, the first stabilizer frames 505 are separated by a first gap 512, and the second stabilizer frames 510 are separated by a second gap 514.

Figure 20:
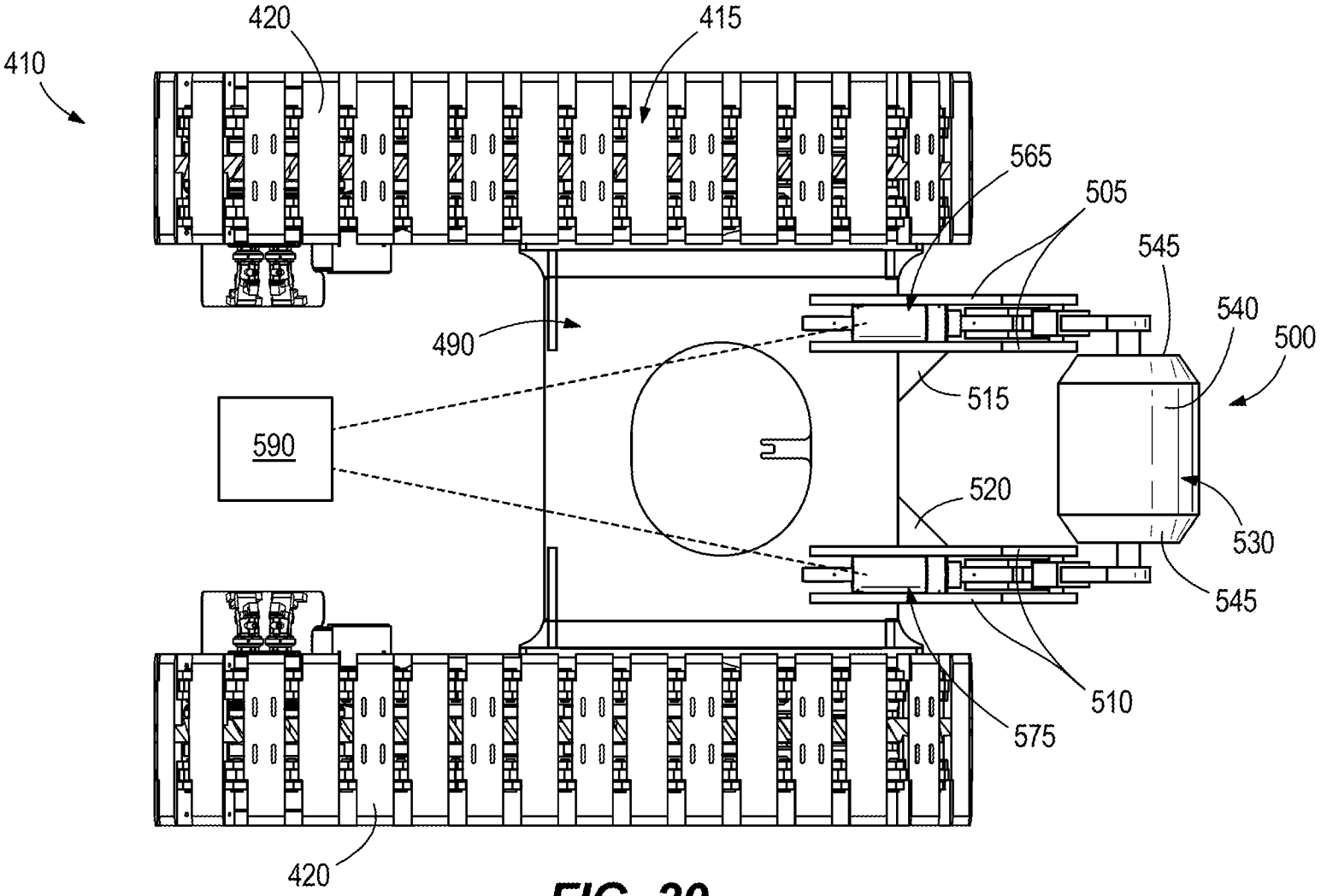
Figure 21:
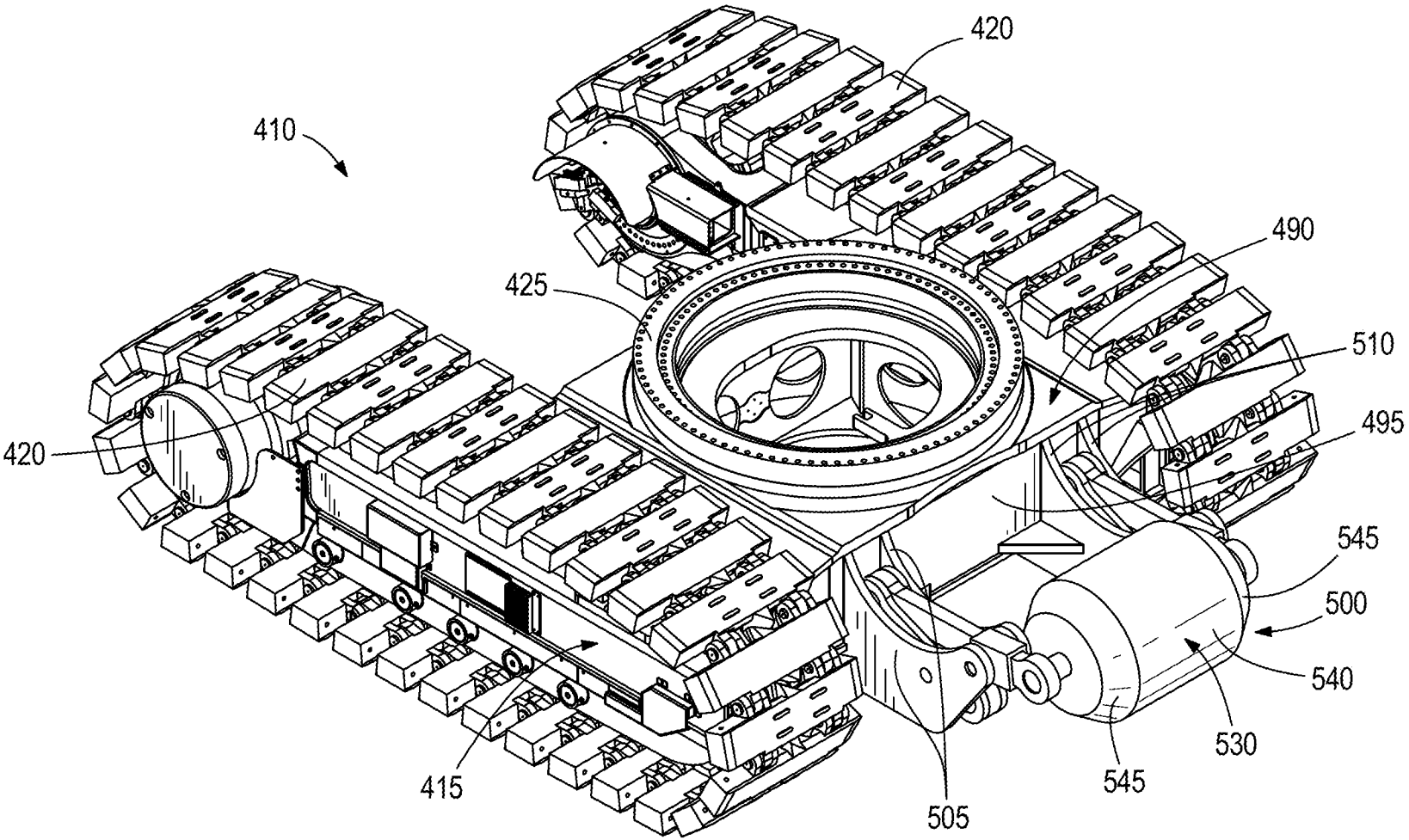
FIGS. 21-25 are perspective, side, and bottom views of the shovel stabilizer appendage of FIGS. 16-20, with the stabilizer appendage in a propel position.
Figure 22:
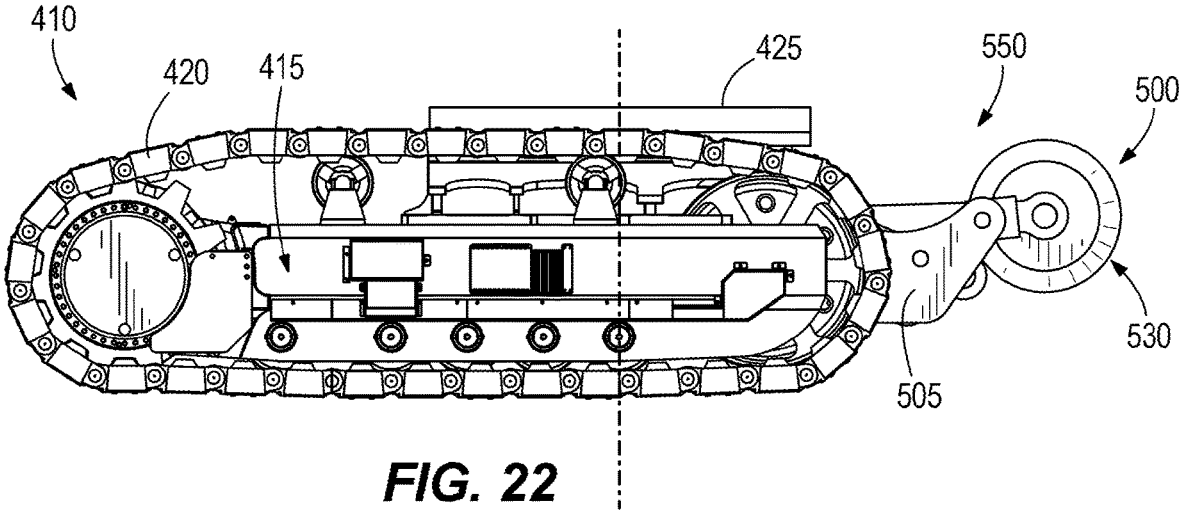
Figure 23:
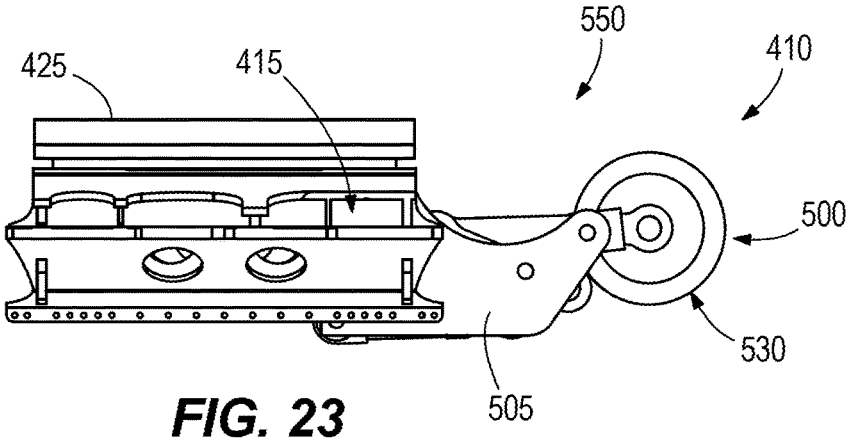

Referring to FIG. 20, the stabilizer appendage 500 further includes a first support rib 515 fixed to one of the first stabilizer frames 505 and the front end 495 of the carbody 490, and a second support rib 520 fixed to one of the second stabilizer frames 510 and the front end 495 of the carbody 490. The first and second support ribs 515, 520 each have a generally triangular shape. Other constructions include various other shapes, sizes, numbers, and arrangements of stabilizer frames and/or support ribs than that shown.

Referring to FIGS. 16-25, in the illustrated construction, the stabilizer appendage 500 includes a bearing element 525, and a roller 530 coupled to the bearing element 525 for rotation about the bearing element 525. The bearing element 525 is a fixed cylindrical rod that extends entirely through an aperture 535 of the roller 530. Similar to the roller 130, the roller 530 has a generally cylindrical shape, with a main outer surface 540 and two chamfered surfaces 545 on either side of the main outer surface 540.

Figure 19:
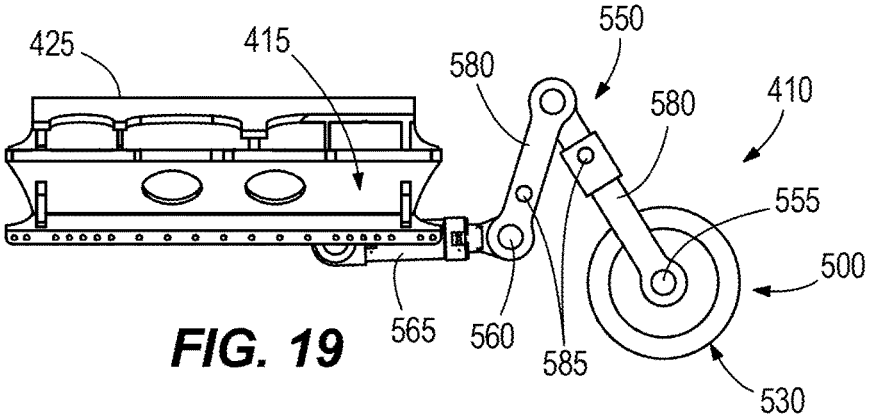
Figure 24:
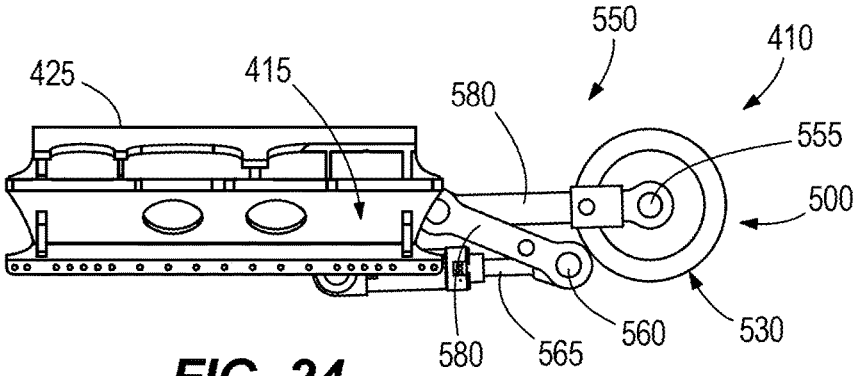
Figure 25:
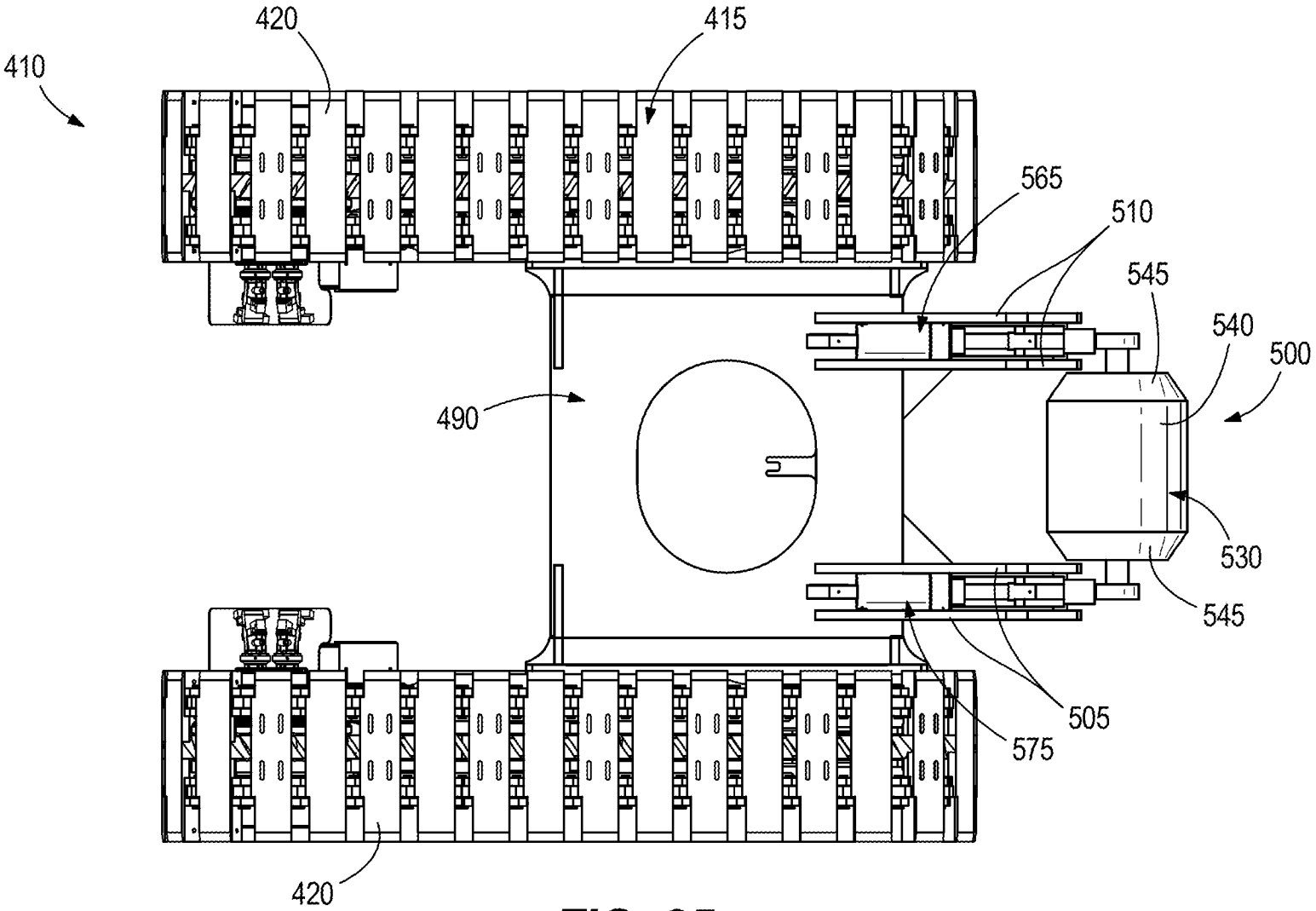

The roller 530 of the stabilizer appendage 500 is movable between a digging position (FIGS. 16-20) and a propel position (FIGS. 21-25). To accommodate this movement, the stabilizer appendage 500 includes a first link arm assembly 550 having a first end 555 coupled to the bearing element 525, and a second end 560 coupled to a first actuator 565 (FIGS. 19 and 24). The first actuator 565 is coupled (e.g., pivotally coupled) to the mobile base 415. The stabilizer appendage 500 further includes a second link arm assembly 570 (FIG. 16) coupled to both the bearing element 525 and a second actuator 575 (FIG. 20), the second actuator 575 also being pivotally coupled to the mobile base 415.

Referring to FIG. 19, in the digging position the roller 530 is at a lowest position, and is in contact with a ground or support surface. In this position, the first actuator 565 is fully retracted (or may be fully extended, depending on the type and position of actuator used). The first link arm assembly 550 includes two first link arms 580 that are pivotally coupled to one another (e.g., with a pin) at ends thereof, such that in the digging position the first link arms 580 form a V-shape as illustrated in FIG. 19. Referring to FIGS. 16 and 19, the first link arms 580 are also pivotally coupled to the first stabilizer frames 505 at pivot points 585 (e.g., pins extending through the first stabilizer frames 505 and through the first link arms 580). In the illustrated construction, the first actuator 565 and the second actuator 575 are hydraulic cylinders mounted on a bottom of the carbody 490, although other constructions include different numbers and types of actuators (e.g., pneumatic, rack and pinion, etc.) to move the link arms 580, as well as different mounting locations for the first and second actuators 565, 575. Other constructions include different numbers and arrangements of link arms than that illustrated.

Referring to FIG. 24, in the propel position the roller 530 is at a highest position, and out of contact with the ground or support surface. In this position, the actuator 565 is fully extended (or may be fully retracted, again depending on the type and position of actuator used). As illustrated in FIG. 24, in this position the first link arms 580 have pivoted relative to one another, as well as relative to the first stabilizer frames 505, such that the first link arm assembly 550 is in a generally folded, compact state.

While not illustrated, the second actuator 575 and the second link arm assembly 570 function similarly and in conjunction with the first link arm assembly 550 and the first actuator 565 to move the roller 530 between the digging position and the propel position. Referring to FIG. 20, the mining shovel 410 further includes a controller 590 coupled to the first actuator 565 and the second actuator 575, to control movement of the first link arm assembly 550 and the second link arm assembly 570, and thus upward and downward movement of the roller 530. The controller 590 may be located, for example, in the mobile base 415 or on another portion of the mining shovel 410. In some constructions, the controller 590 is coupled to a display or other control within an operator cab of the mining shovel 410.

In some constructions, during use the controller 590 determines (e.g., based on manual input from an operator or input from one or more sensors) that the mining shovel 410 is in a digging operation (e.g., the drive tracks 420 are stationary and the dipper is moving or about to move and dig through material) or a propel operation (e.g., the mining shovel 410 is no longer digging and instead is moving from one mining location to another). If the mining shovel 410 is in a digging operation, the controller 590 causes the first actuator 565 and the second actuator 575 to fully retract (i.e., to the position illustrated in FIGS. 16-19), forcing the roller 530 to lower to the ground or support surface, and to aid in absorbing tipping forces as the mining shovel 410 digs through material or moves material. In some constructions, the links arms 580 lock in place once the roller 530 is lowered (e.g., either naturally through their orientation and through the positioning of the pivot points 585, or through a lock mechanism (not shown) that locks their position).

If the mining shovel 410 is in a propel operation, the controller 590 causes the first actuator 565 and the second actuator 575 to fully extend (i.e., to the position illustrated in FIGS. 20-25), forcing the roller 530 to rise above the ground or support surface, such that the roller 530 does not interfere or otherwise slow movement of the mining shovel 410. In some constructions, the operator may manually override the controller 590 to leave the roller 530 down in the propel operation (wherein the roller 530 may simply roll over the ground or support surface during movement), or may leave the roller 530 partially or entirely up during a dig operation (e.g., if it is determined that the roller 530 is not needed for stabilization purposes).

In some constructions, the controller 590 also, or alternatively, provides an alarm to the operator regarding a tipping condition of the mining shovel 410. For example, in some constructions, if a cylinder pressure in one of the actuators 565, 575 reaches or exceeds a predetermined threshold (e.g., based on detection by one or more sensors), the controller 590 alerts the operator (e.g., visually or audibly) to cease digging or reduce digging loads, or a hoist bail pull effort can be automatically reduced and limited by a controller (e.g., the controller 500 may automatically reduce an available hoist bail speed and torque). In some constructions, the mining shovel 410 includes one or more pressure relief valves for hydraulic fluid within the first and second actuators 565, 575 to protect the assembly from structural damage. The pressure relief valves may provide an indication of the tipping condition.

Figure 26:
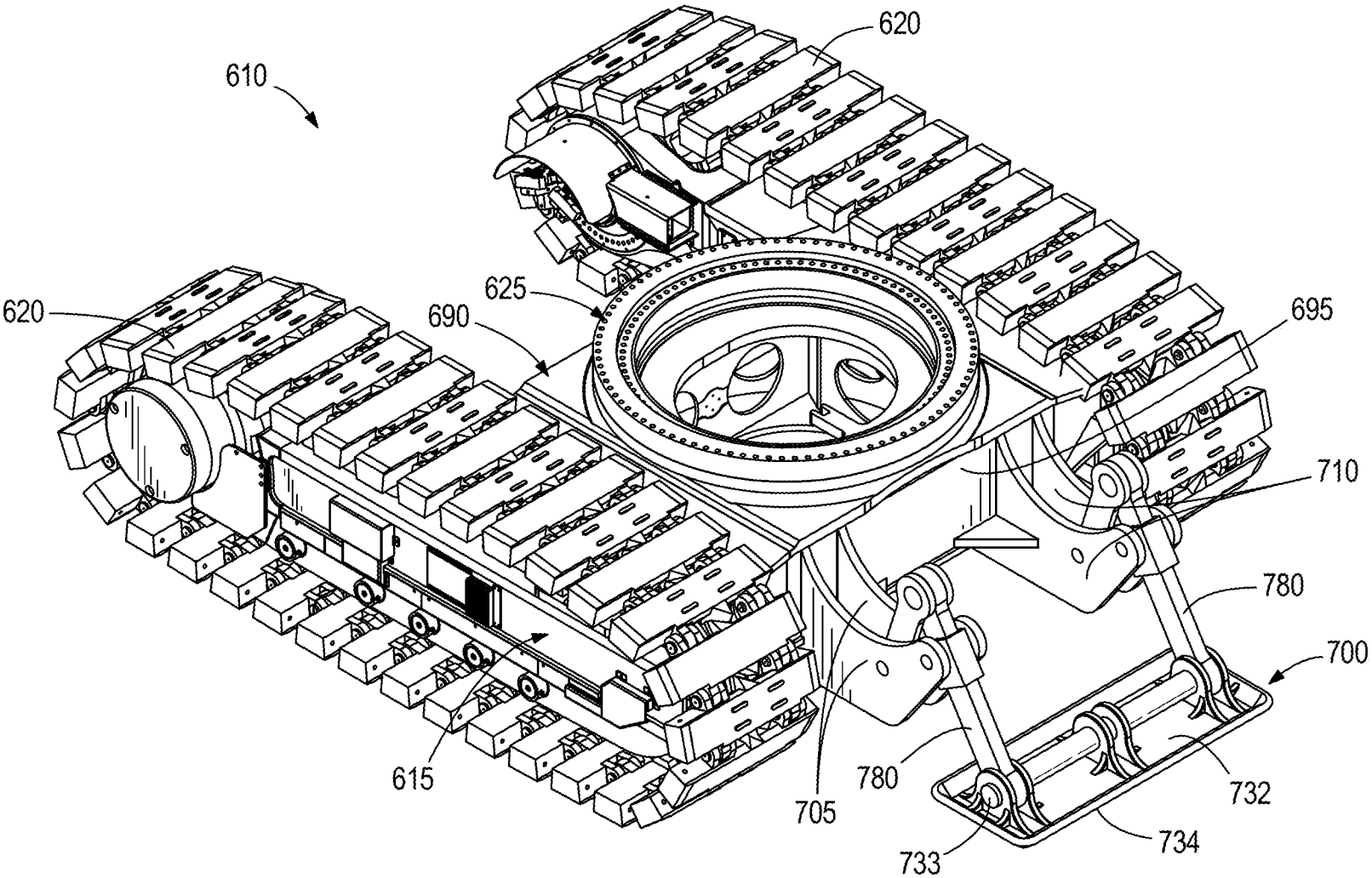
FIGS. 26 and 27 are perspective views of a shovel stabilizer appendage according to another construction.
Figure 27:
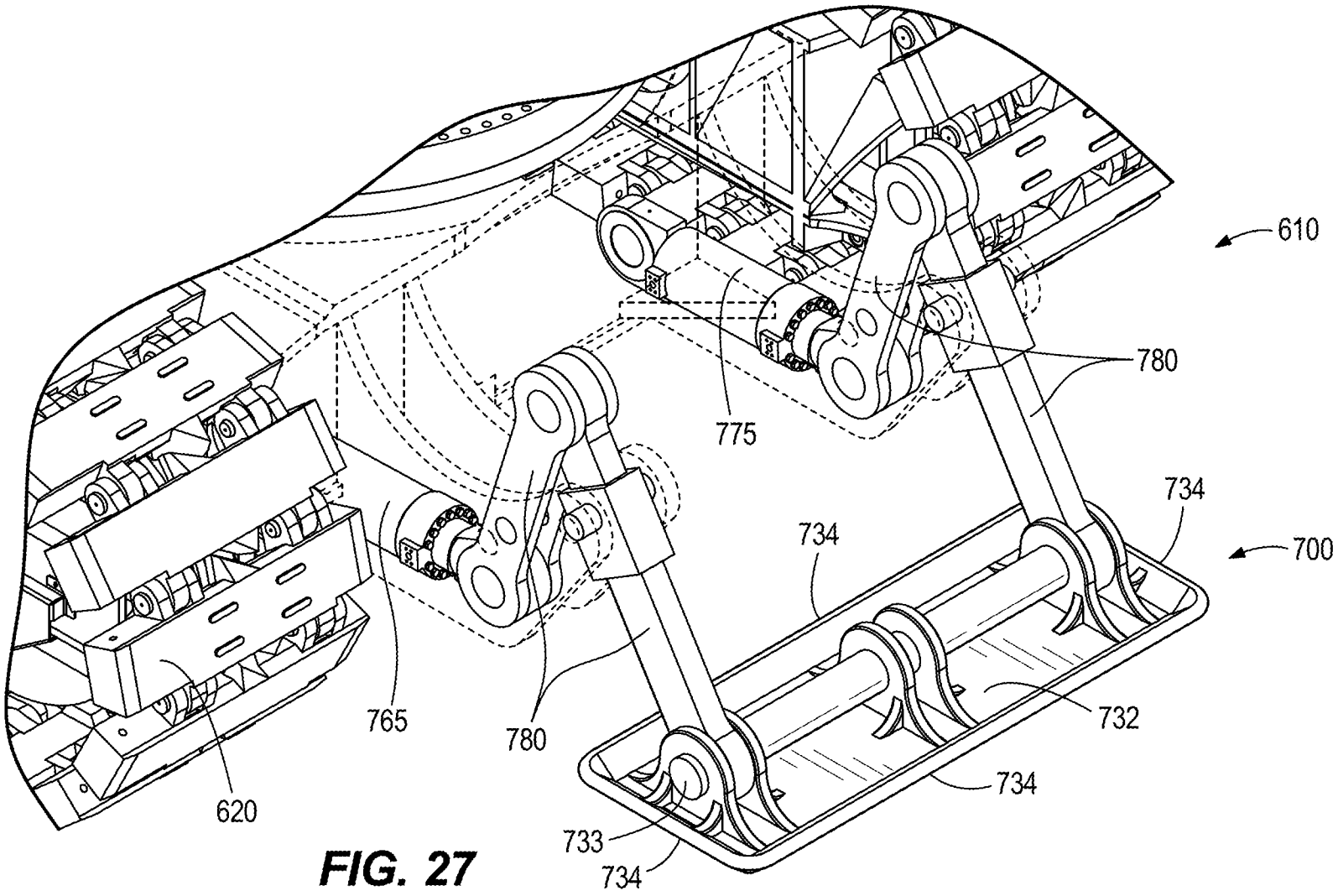

FIGS. 26 and 27 illustrate a portion of a mining shovel 610. The mining shovel 610 is similar to the mining shovel 410, and thus similar components are given identical numbers, increased by 200. As illustrated in FIGS. 26 and 27, the mining shovel 610 includes a stabilizer appendage 700. The stabilizer appendage 700 differs from the stabilizer appendage 500 of the mining shovel 410 in that the stabilizer appendage 700 does not include a roller 530. Rather, the stabilizer appendage 700 includes a plate 732 (e.g., a flat plate) in place of the roller 530. The plate 732 extends between link arms 780, and is raised and lowered between propel and digging positions, respectively, with first and second actuators 765, 775, similar to the roller 530 in FIGS. 16-25. In the illustrated construction, the plate 732 is permitted to swivel about a bearing 733 (similar to the roller 130), and includes one more raised or chamfered surfaces 734 to facilitate plowing of material away from the plate 732.

Figure 28:
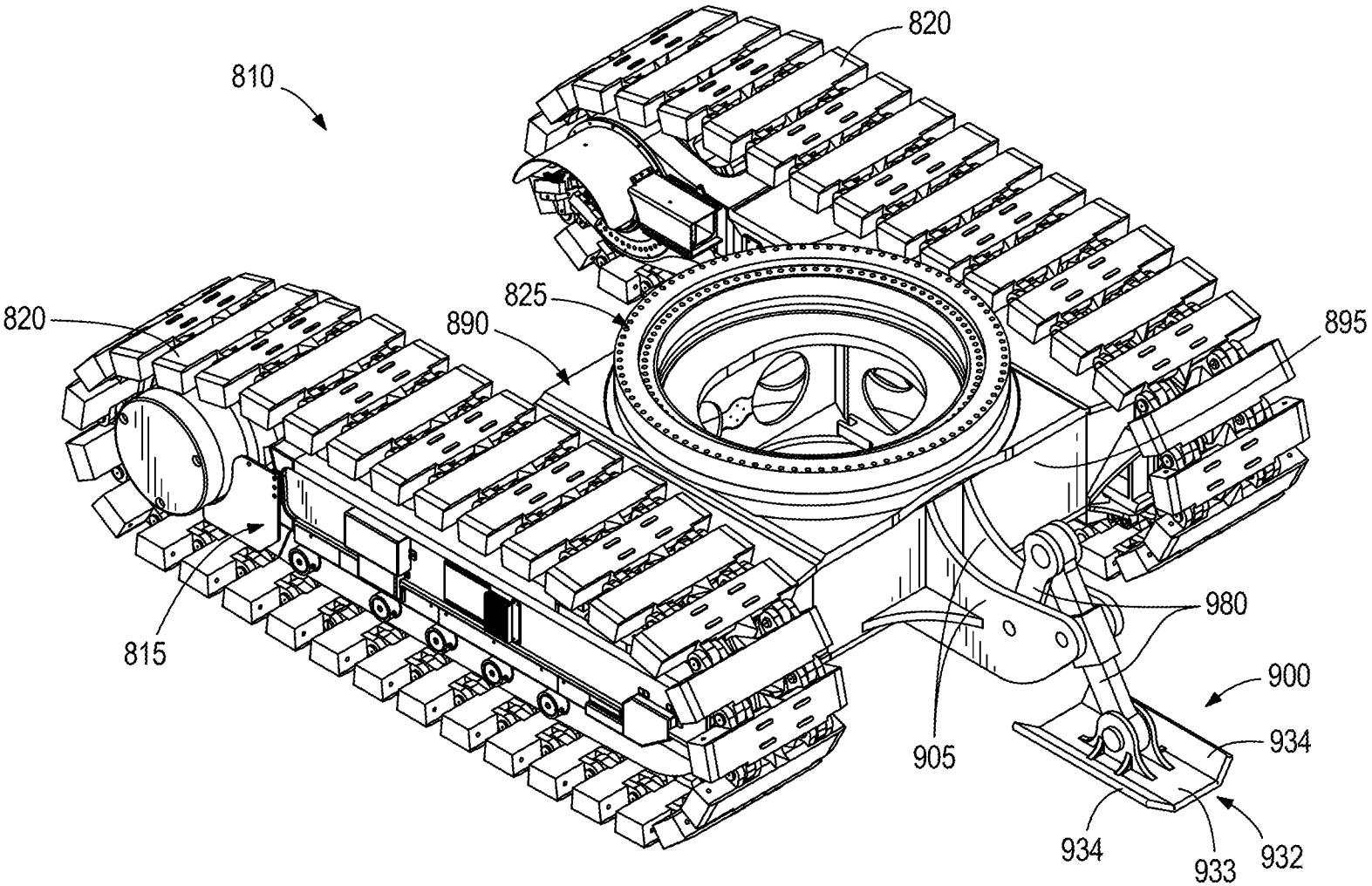
FIGS. 28-33 are perspective, side, and top views of a shovel stabilizer appendage according to another construction, with the stabilizer appendage in a digging position.
Figure 29:
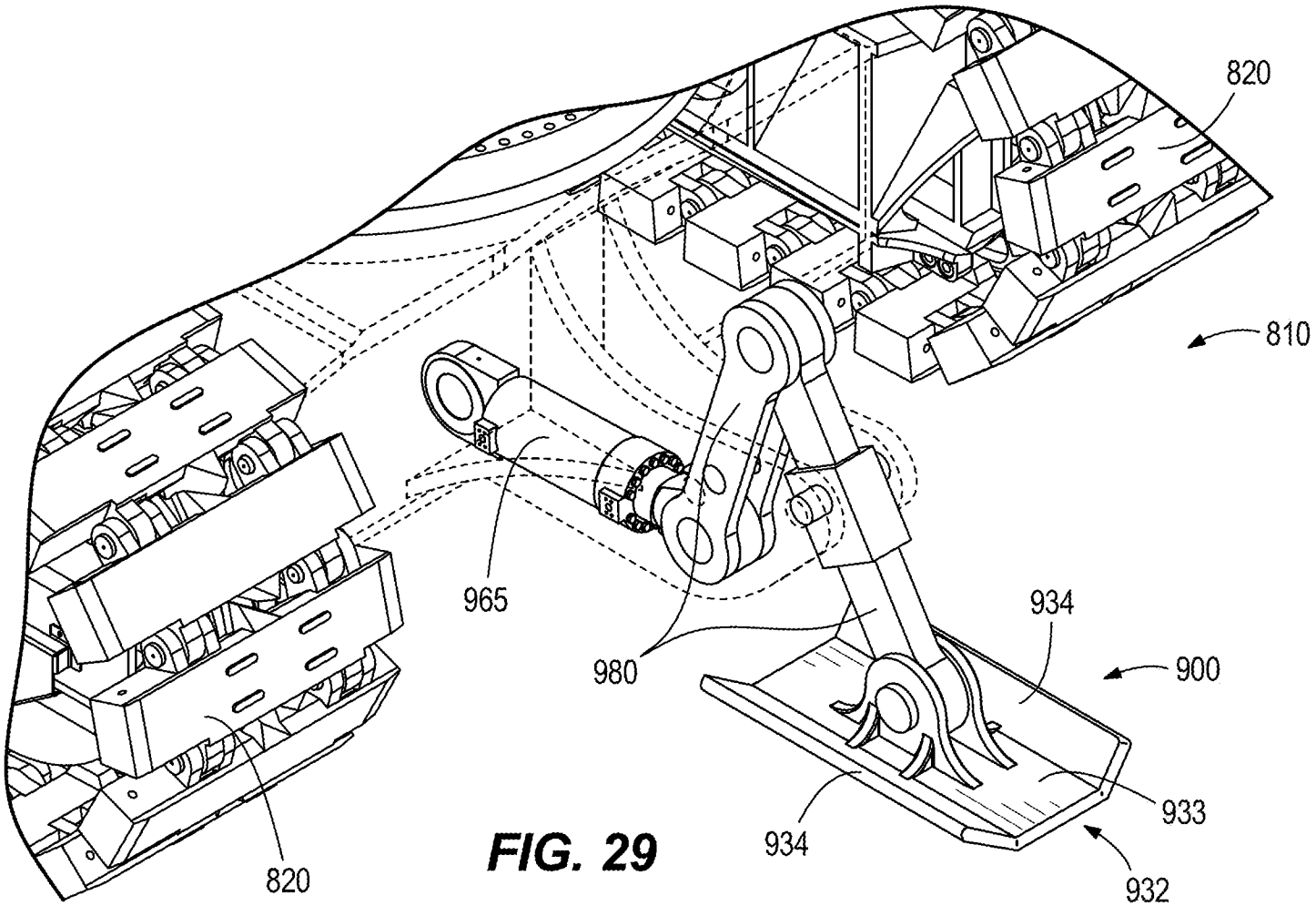
Figure 30:
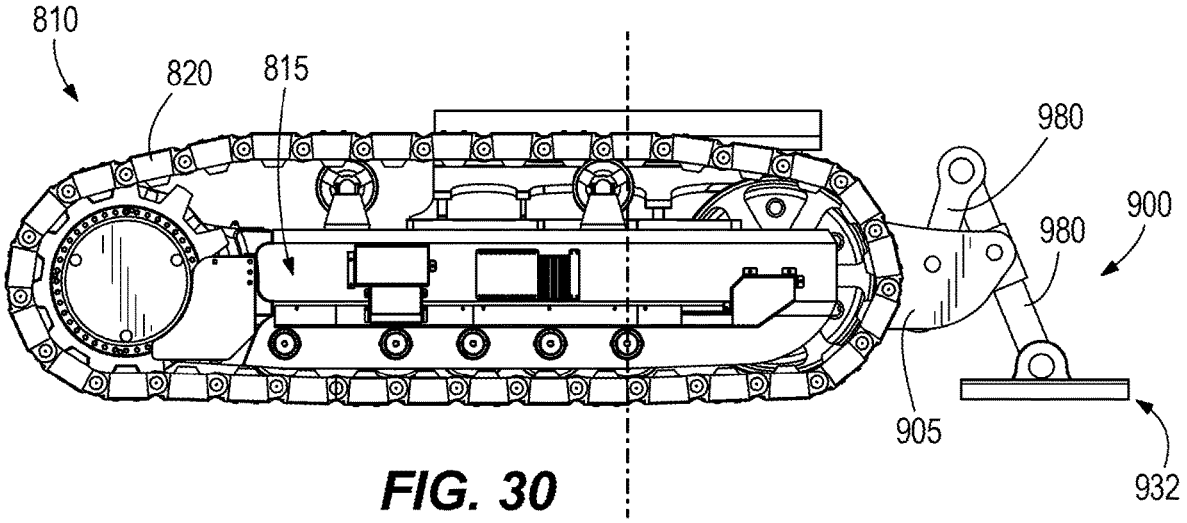
Figure 31:
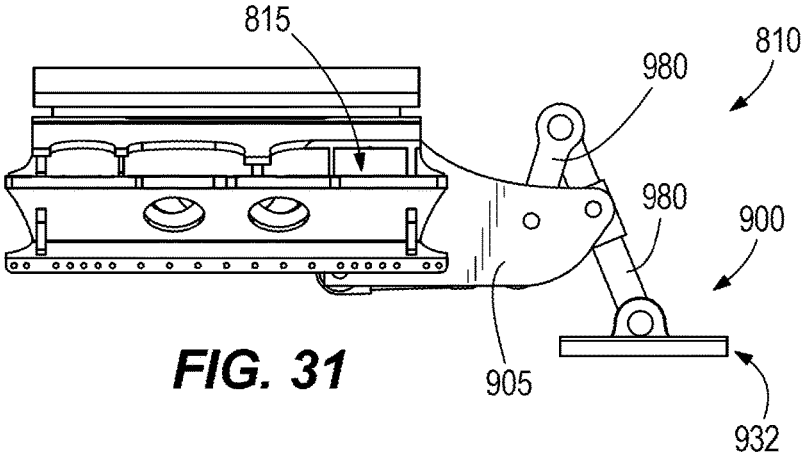
Figure 32:
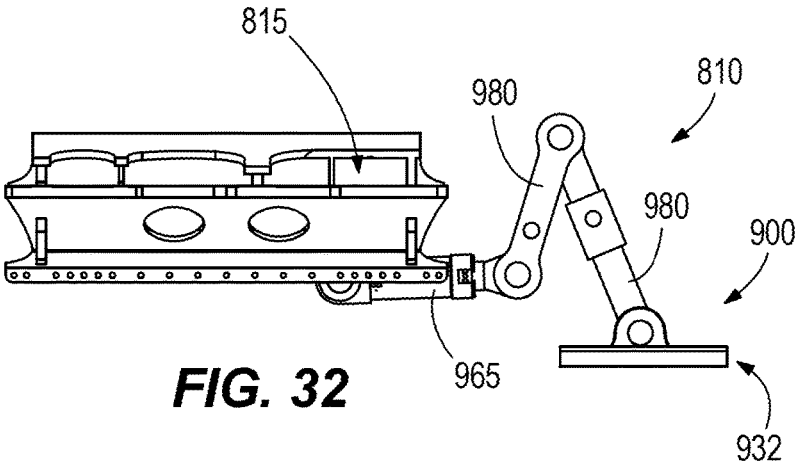
Figure 33:
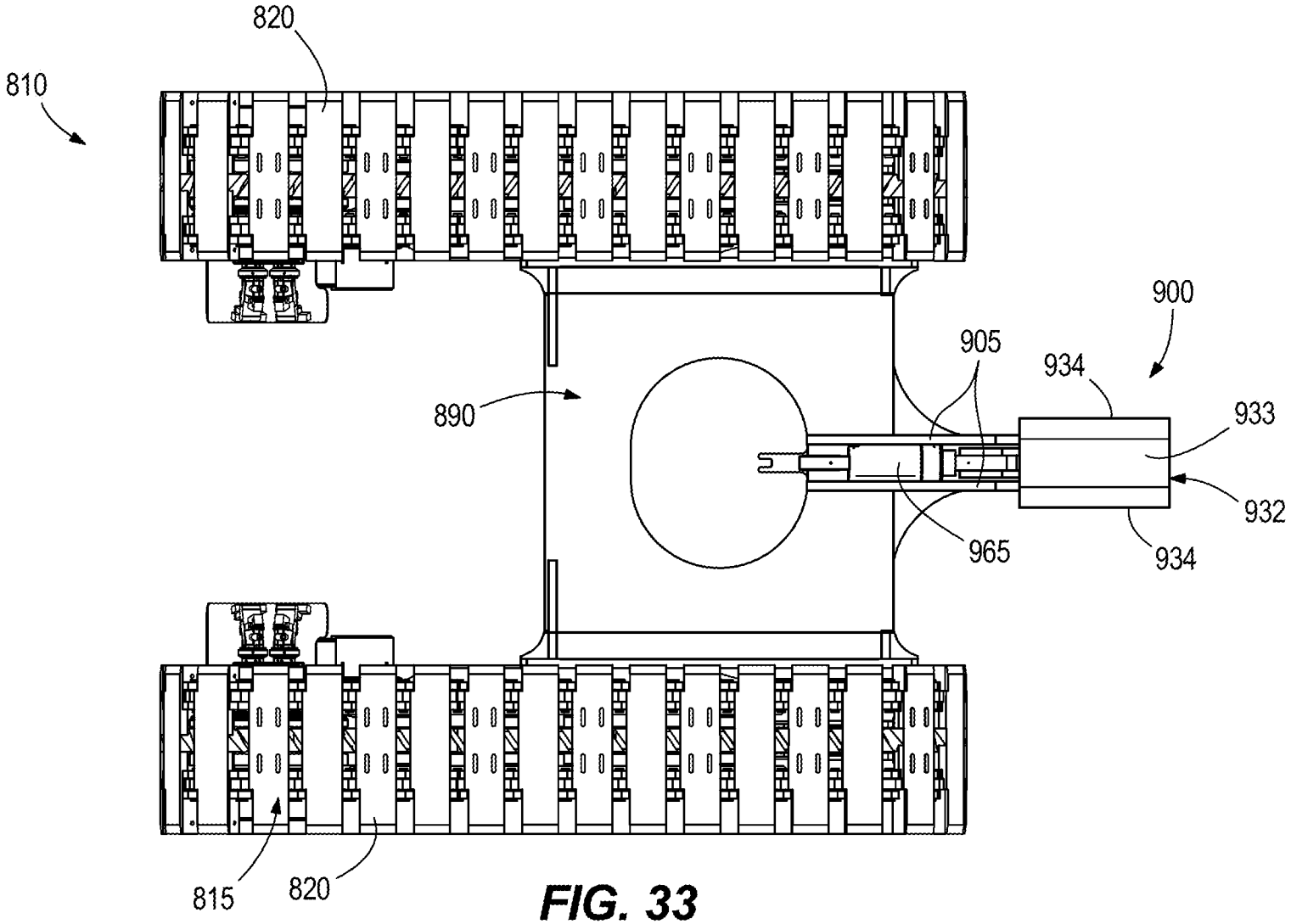
Figure 34:
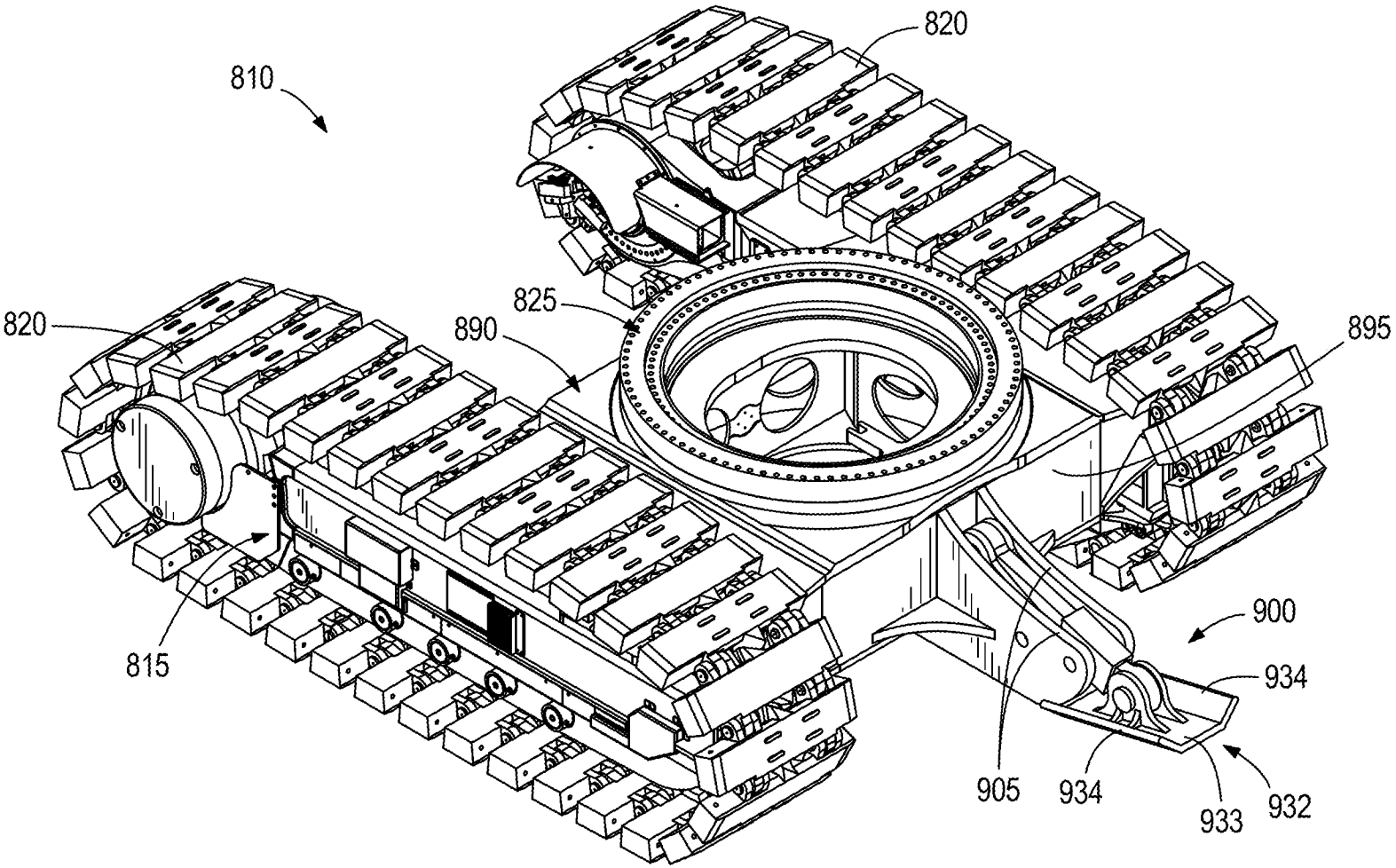
FIGS. 34-38 are perspective, side, and top views of the shovel stabilizer appendage of FIGS. 28-33, with the stabilizer appendage in a propel position.
Figure 35:
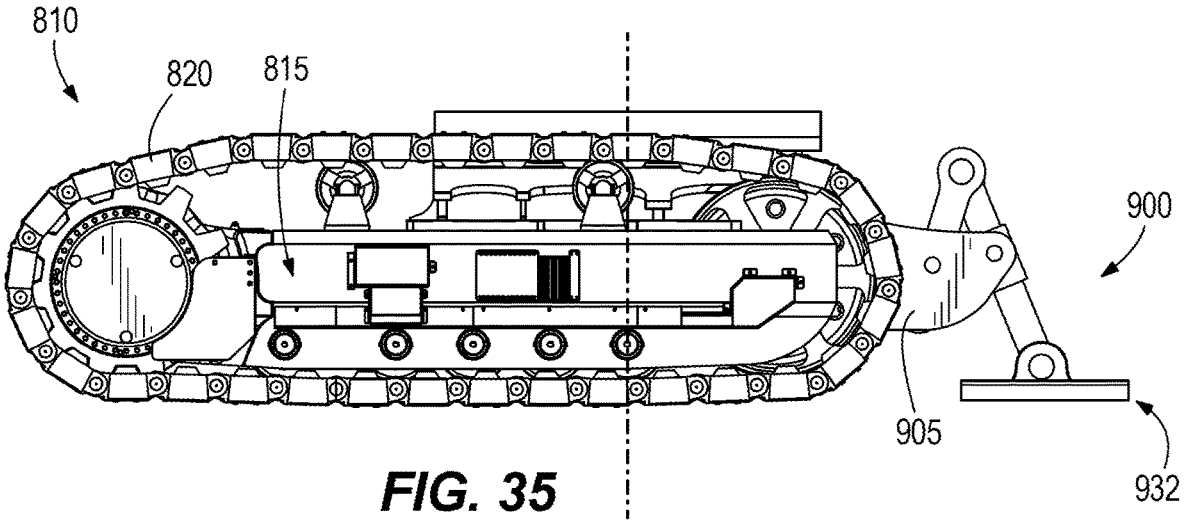
Figure 36:
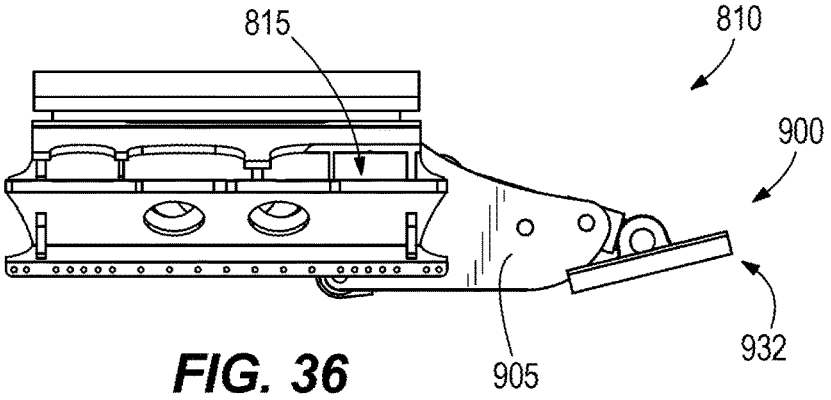
Figure 37:
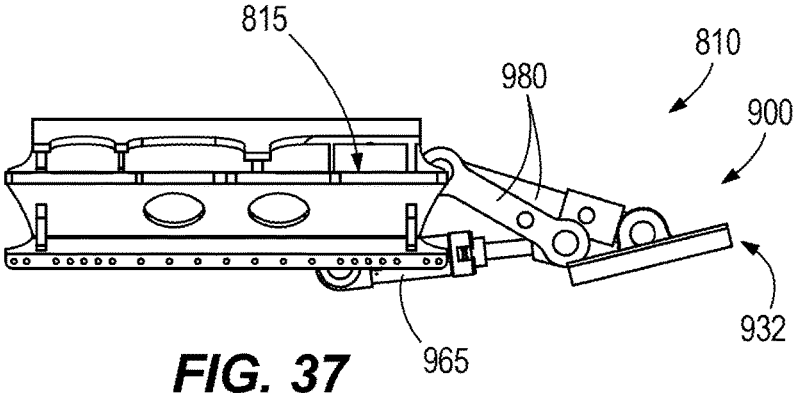
Figure 38:
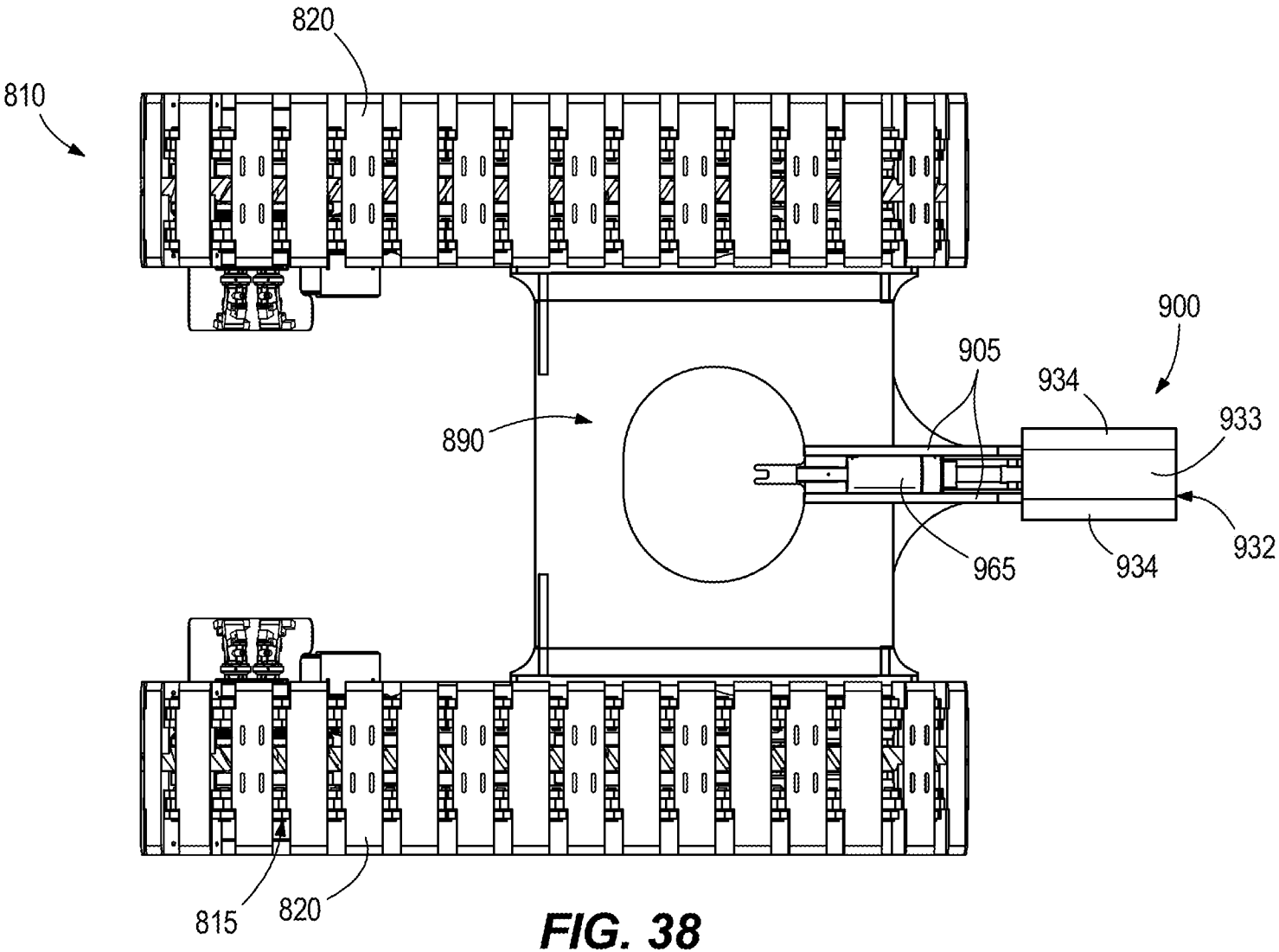
Figure 39:
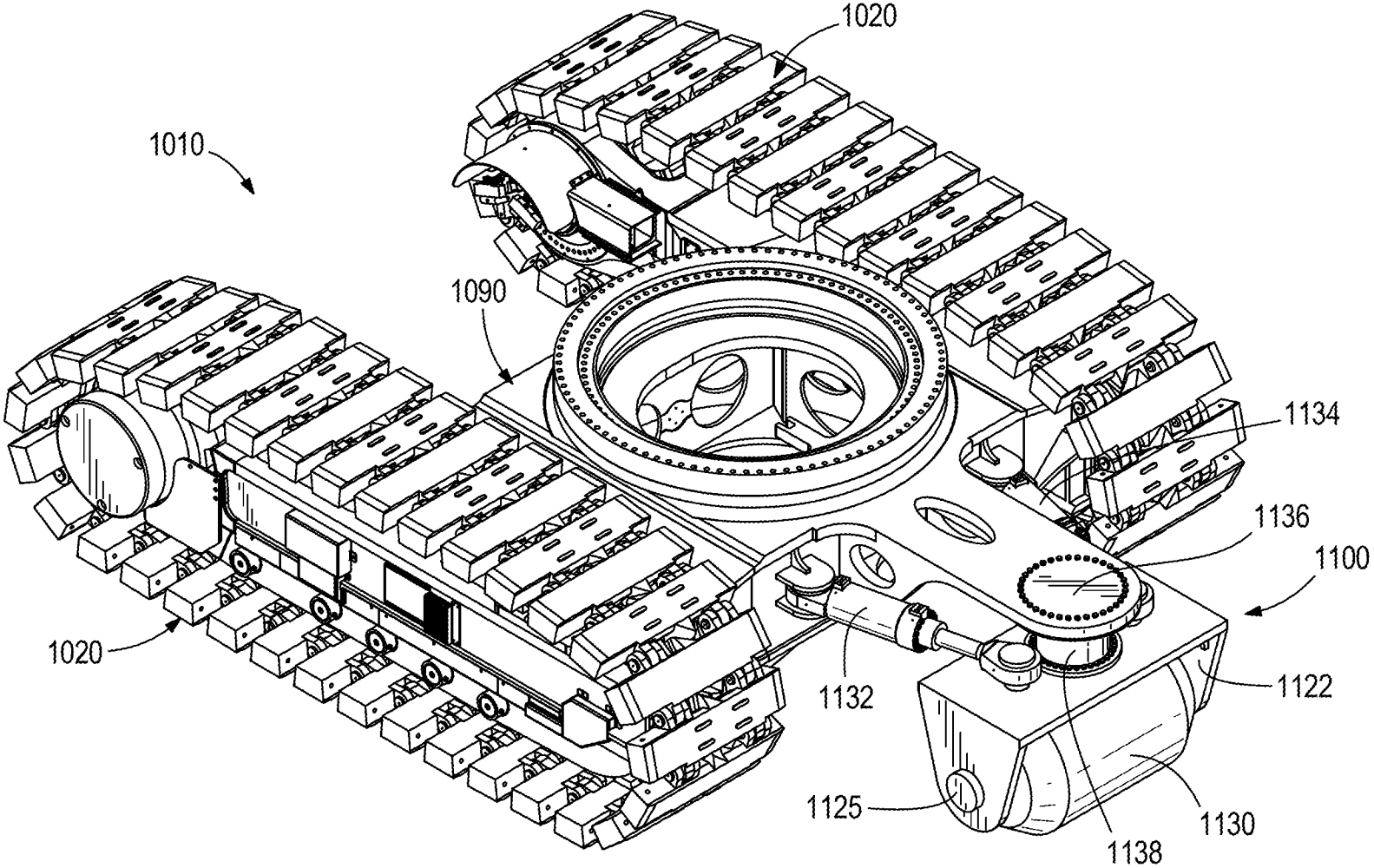
FIGS. 39-45 are perspective, side, front, and top views of a portion of a mining machine according to another construction.

FIGS. 28-38 illustrate a portion of a mining shovel 810. The mining shovel 810 is similar to the mining shovel 410, and thus similar components are given identical numbers, increased by 400. As illustrated in FIGS. 28-38, the mining shovel 810 includes a stabilizer appendage 900. The stabilizer appendage 900 includes a plate 932 (e.g., a flat plate), and includes a single set of stabilizer frames 905 and two link arms 980. The plate 932 is raised and lowered between digging (FIGS. 28-33) and propel (FIGS. 34-38) positions, respectively, with a single actuator 965, similar to the roller 530 in FIGS. 16-25. In other constructions, multiple plates 932 (e.g., two, three, four, etc.) are provided, each activated by its own single actuator 965. As illustrated in FIG. 28, the plate 932 includes a first portion 933 that contacts the ground or support surface, and second portions 934 (e.g., wings) that extend generally upwardly and away from the first portion at an oblique angle relative to the first portion 933. Other constructions include various other arrangements.

Referring to FIGS. 1-38, in some constructions one or more portions of the stabilizer appendages 100, 500, 700, 900 described above are turned laterally during a propel operation to accommodate lateral turning movements of the mining shovel 10, 410, 610, 810. For example, in some constructions one or more actuators (e.g., hydraulic, etc.) are provided to turn the stabilizer frames, rollers, and/or plates described above, so as to limit any skidding or other frictional resistance that might otherwise be generated by the stabilizer appendages contacting the ground surface during the propel operation. Referring to FIG. 2 in particular, in some constructions one or more actuators are provided to turn the stabilizer frames 105, 110 and/or the roller 130, thus pivoting the frames 105, 110 and/or the roller 130 left and right relative to the front end 95 of the carbody 90 to generally match a corresponding left and right turning movement of the mining shovel 10 itself. In some constructions, a castor structure may be provided that includes a thrust bearing and a steerable pin that controls a direction of rolling of the roller 130. Other constructions include various other steering arrangements to facilitate lateral steering of the stabilizer appendages 100, 500, 700, 900.

FIGS. 39-45 illustrate a portion of a mining shovel 1010. The mining shovel 1010 is similar to the mining shovel 10, and thus similar components are given identical numbers, increased by 1000. As illustrated in FIGS. 39-45, the mining machine 1010 includes drive tracks 1020, a carbody 1090 coupled to the drive tracks 1020, and a stabilizer appendage 1100 coupled to the carbody 1090. The stabilizer appendage 1100 includes a frame 1122, a bearing element 1125 (e.g., a pin, bushing, and/or other bearing structure) coupled to the frame 1122 at opposite ends of the bearing element 1125, and a roller 1130 (e.g., a barrel) coupled to the bearing element 1125 for rotation about the bearing element 1125. The frame 1122 extends over at least a portion of the roller 1130 (e.g., to shield the roller 1130).

With continued reference to FIGS. 39-45, the stabilizer appendage 1100 further includes a first actuator 1132 and a second actuator 1134, each coupled at one end to the carbody 1090 and at an opposite end to the frame 1122. In the illustrated construction, the first and second actuators 1132, 1134 are each hydraulic cylinders, having an extended length equal to 1.6 times a retracted length. Other embodiments include different actuators (e.g., pneumatic, etc.), as well as different extension and retraction distances.

Figure 40:
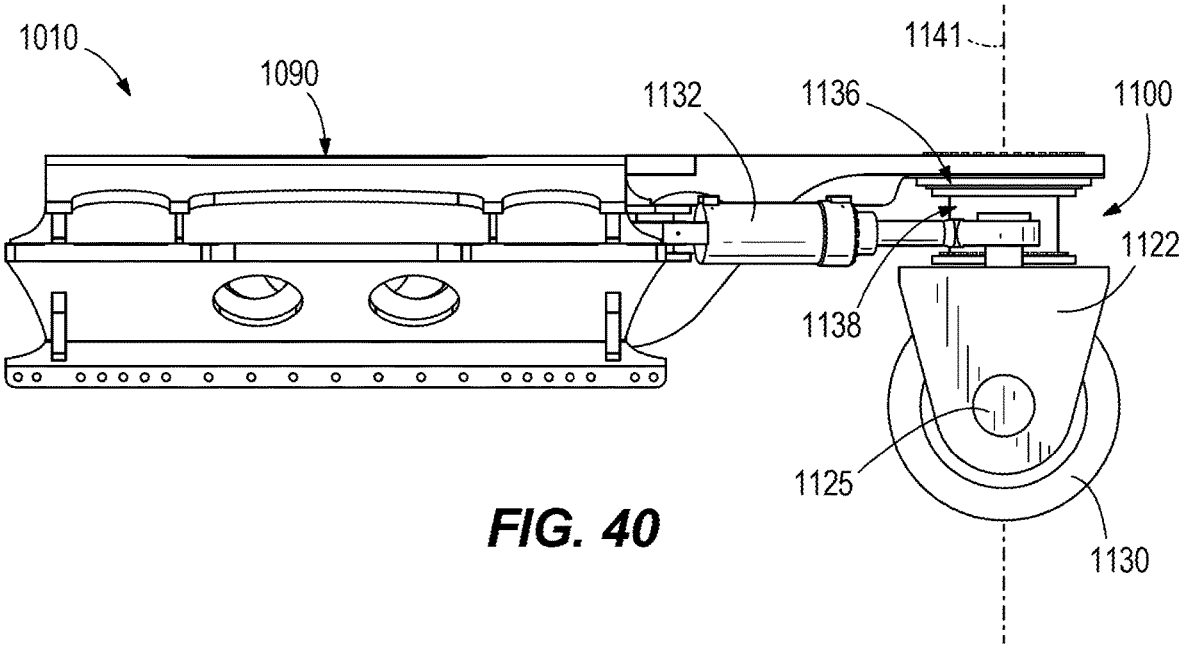
Figure 41:
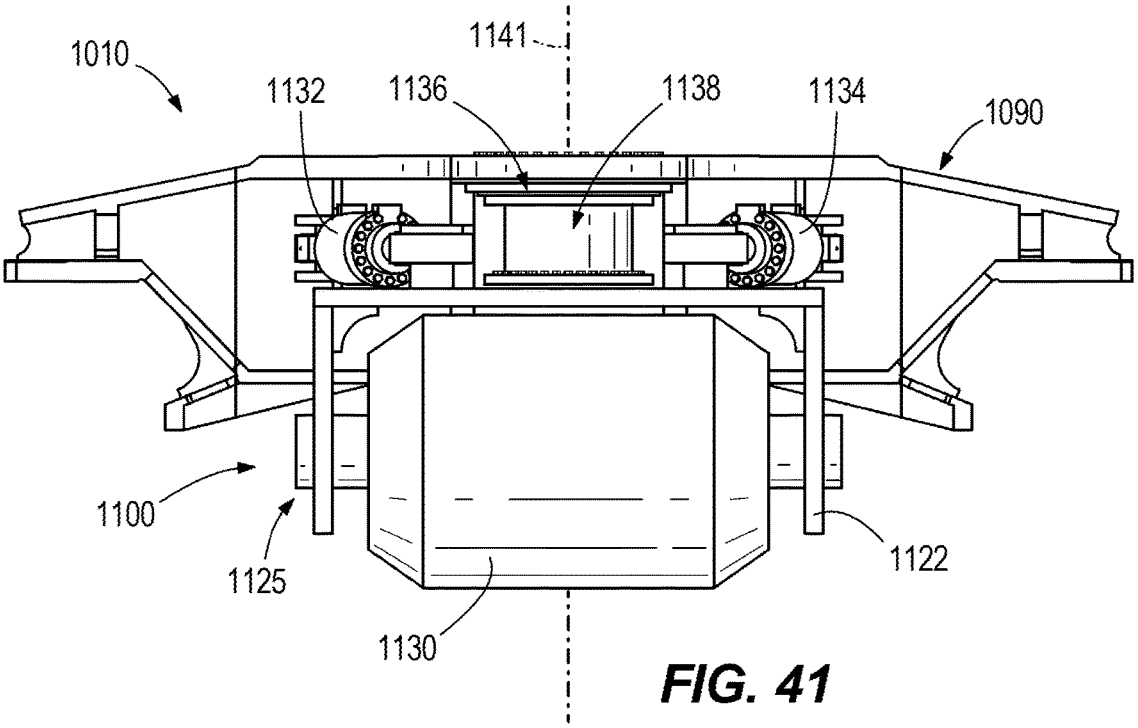
Figure 42:
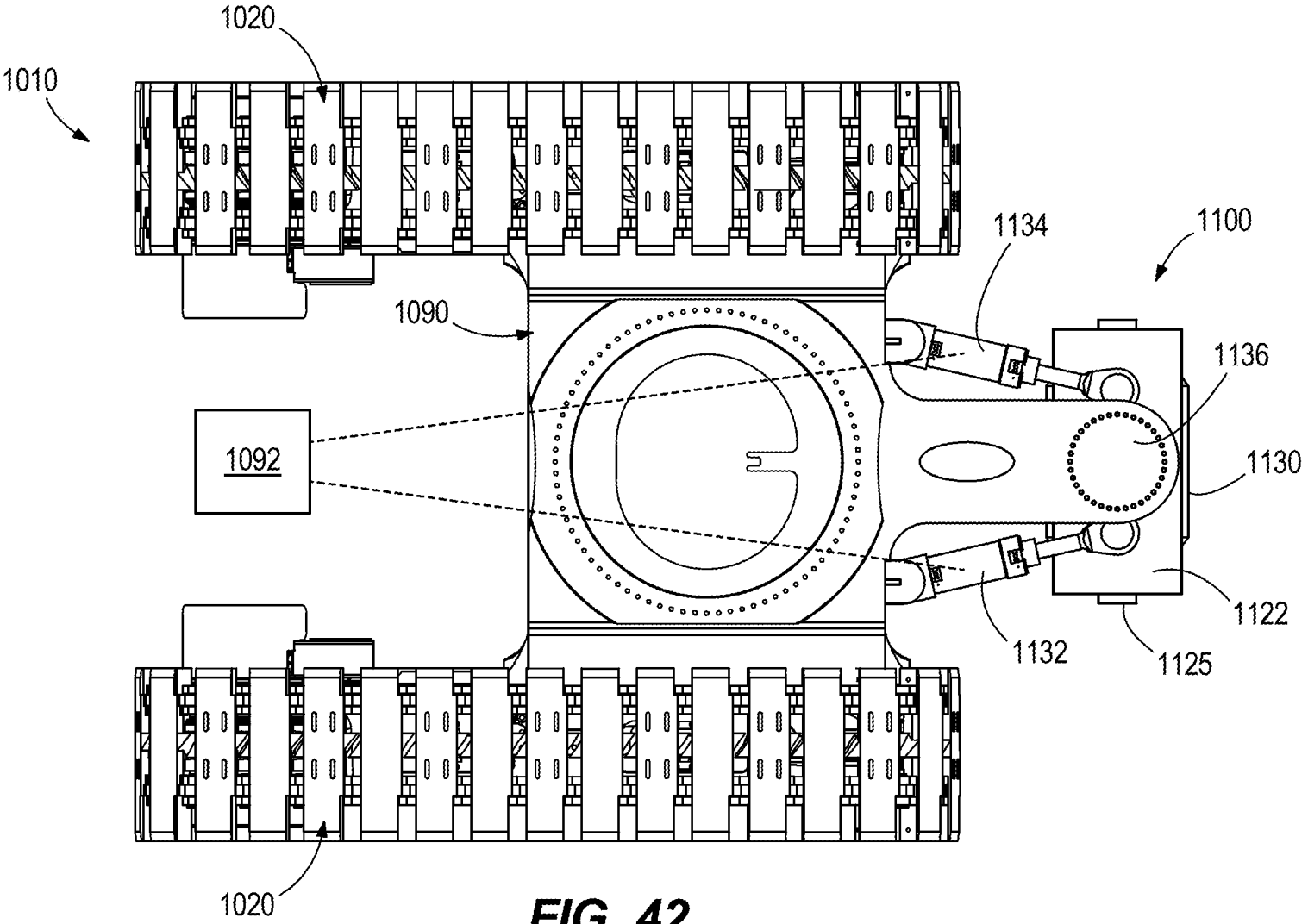
Figure 43:
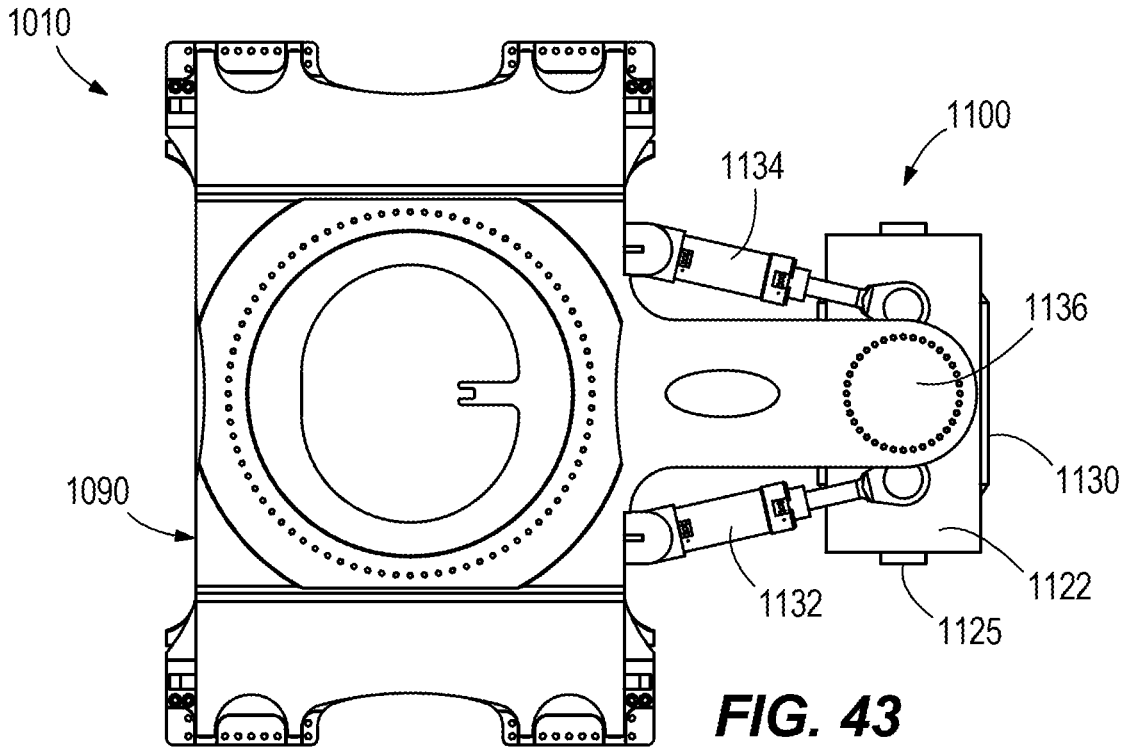

The stabilizer appendage 1100 further includes a thrust bearing 1136 coupled to the carbody 1090 (e.g., to an extending arm of the carbody 1090), and a spacer 1138 coupled to the thrust bearing 1136 and the frame 1122. As illustrated in FIGS. 39-45, when the first and/or second actuators 1132, 1134 are actuated, the frame 1122 (and the roller 1130 and bearing element 1125 coupled thereto) are rotated together about an axis 1141 (FIGS. 40 and 41). The axis 1141 extends through the thrust bearing 1136 and for example is parallel to an axis of rotation of the frame on the turntable (e.g., such as axis 65 or 265). Other constructions include different bearings or structures (e.g., roller bearings, etc.) than that illustrated to permit rotational movement of the frame 1122 and the roller 1130 and the bearing element 1125 relative to the carbody 1090. As illustrated in FIG. 42, in some constructions, the first and/or second actuators 1132, 1134 are coupled to a controller 1092 (e.g., similar to controller 590). The controller 1092 actuates the first actuator 1132 and/or the second actuator 1134 to cause a turning movement of the roller 1130. The turning movement of the roller 1130 may facilitate both turning of the roller 1130, as well as of the mining shovel 10 overall. In some constructions, the mining shovel 1010 uses operator steering feedback (e.g., via the controller 1092) to control both the drive tracks 1020 and the turning of the roller 1130 in a synchronized manner. For example in some constructions operating steering feedback is used to synchronize the first and second actuators 1132, 1134 to differential speed commands of each drive track 1020. In operation, the operator generates commands or signals to steer the mining machine 1010 with the drive tracks 1020 themselves, providing differential steering as a result of one drive track 1020 speed being different than the other drive track 1020 speed. The greater the speed difference between the drive tracks 1020, the tighter the operator turning radius that is desired, even up to a pure counter-rotational turning (zero turning radius). The turning movement of the roller 1030 via the first and second actuators 1132, 1134 is controlled automatically (e.g., again via the controller 1092) based on the commands or signals from the operator for the drive tracks 1020, and the turning movement of the roller 1030 is therefore synchronized with the steering of the drive tracks 1020 to turn the roller 1130 with the desired turning radius called for by the operator.

Figure 44:
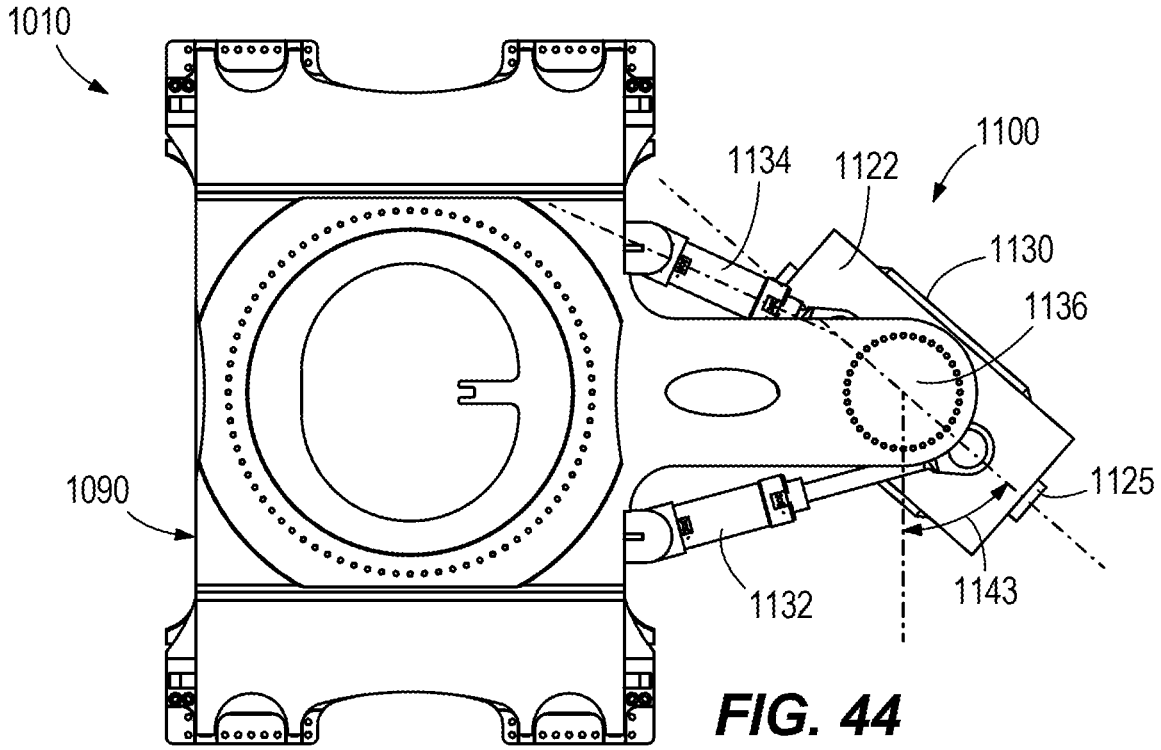
Figure 45:
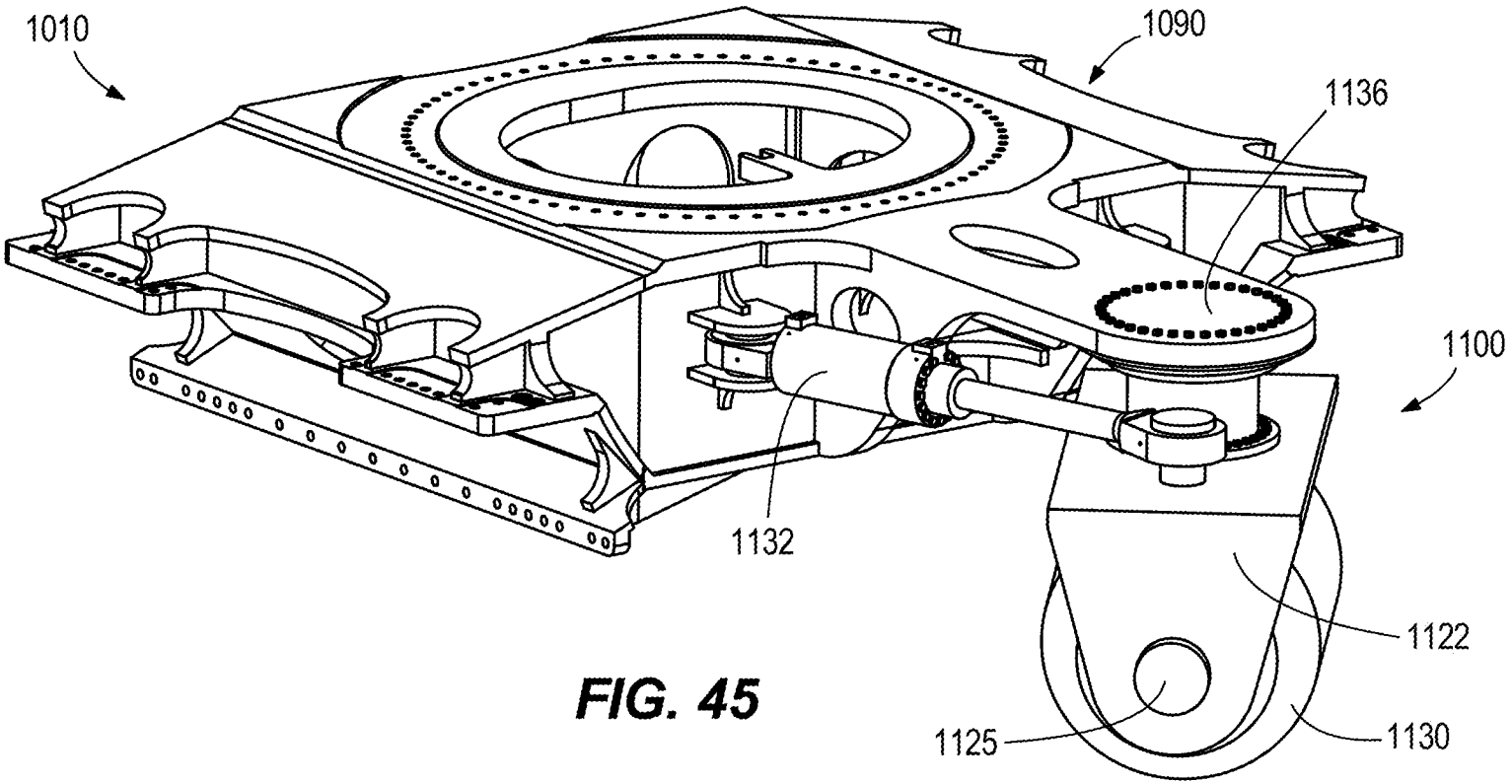

With reference to FIG. 44, the roller 1130 (or plate or other structure of the stabilizer appendage 1100 that is engaging the ground surface) may be turned relative to the carbody 1090 by up to an angle 1143. In the illustrated construction, the angle 1142 is 50 degrees, although in other constructions the angle 1143 is less than or greater than 50 degrees (e.g., up to 30 degrees, up to 40 degrees, up to 60 degrees, up to 70 degrees, up to 80 degrees, up to 90 degrees, etc.).

Figure 46:
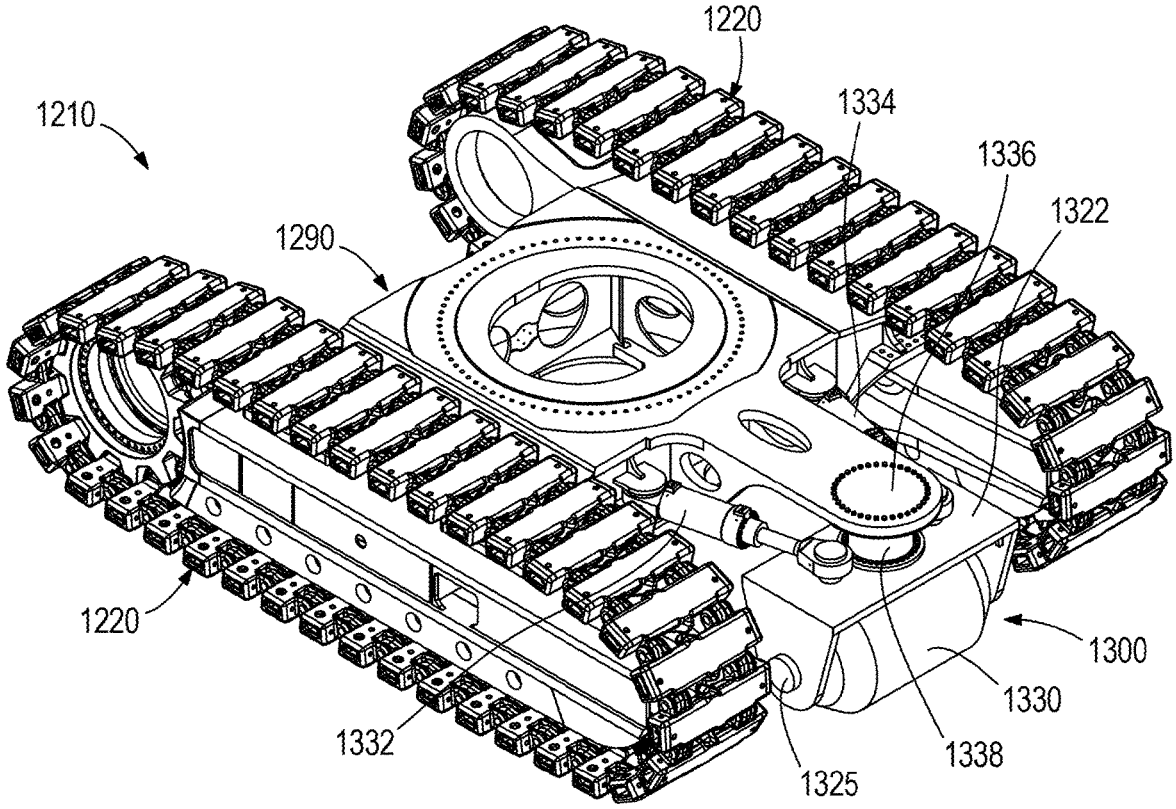
FIGS. 46 and 47 are perspective and side views of a portion of a mining machine according to another construction.
Figure 47:
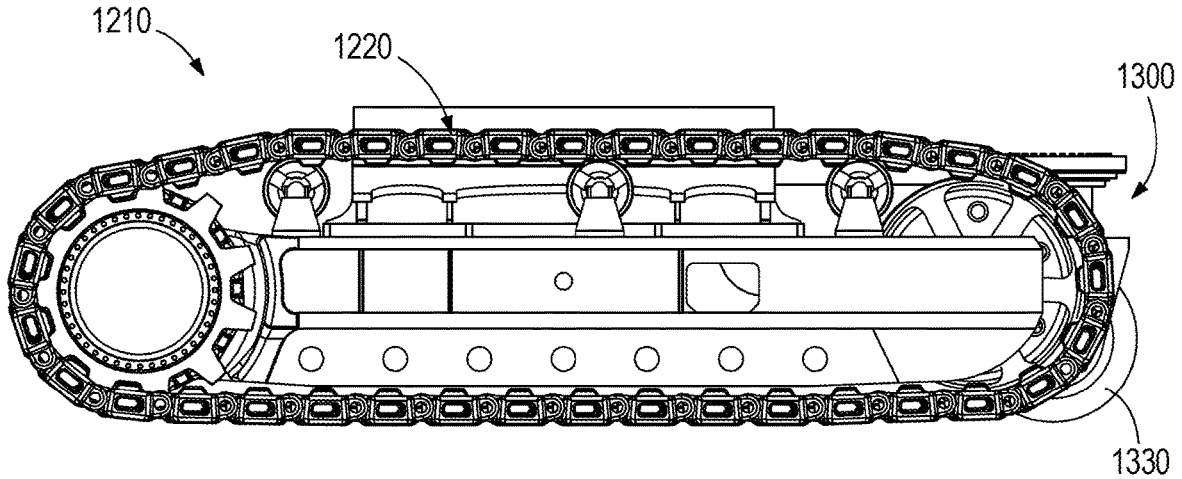

FIGS. 46 and 47 illustrate a portion of a mining shovel 1210. The mining shovel 1210 is similar to the mining shovel 10 illustrated in FIG. 3 (i.e., without the rearward shifting of the drive tracks), and thus similar components are given identical numbers, increased by 1200. As illustrated in FIGS. 46 and 47, the mining machine 1210 includes drive tracks 1220, a carbody 1290 coupled to the drive tracks 1220, and a stabilizer appendage 1300 coupled to the carbody 1290. Similar to the stabilizer appendage 1100, the stabilizer appendage 1300 includes a frame 1322, a bearing element 1325, a roller 1330, a first actuator 1332, a second actuator 1334, a thrust bearing 1336, and a spacer 1338. The carbody 1290 and the stabilizer appendage 1300 are each substantially or entirely contained within a perimeter or a footprint defined by the drive tracks 1220, such that only a small portion of the roller 1330 is visible from a side view of the mining shovel 1210 (FIG. 47). In some constructions, however, even in this arrangement the roller 1330 still exhibits a further outward (or forward) point of contact than an idler of the drive tracks 1220, thus providing greater leverage against forward tipping than would otherwise be provided without the stabilizer appendage 1300.

In yet other constructions, only a single actuator is provided to turn or steer a stabilizer appendage. For example, a portion of any of the stabilizer appendages described herein (e.g., the rollers 130, 530, 1130, 1230) may be turned and steered via a system wherein a vertical pin is mounted to a frame (e.g., frame 1122) and protrudes upwardly from the frame through the carbody (e.g., carbody 1090) of the mining machine. An actuator (e.g., rotary hydraulic motor or electric motor and transmission) coupled to the carbody is then used to rotate the vertical pin and rotationally drive the pin, so as to turn and steer the movement of the stabilizer appendage.

Additionally, in some constructions, one or more actuators (e.g., driving motors) are added not only to steer the stabilizer appendages described herein, but also to cause rotation of the rollers 130, 530, 1130, 1230 themselves (i.e., providing effectively a front-wheel drive for the mining machine), and/or to raise and lower the rollers 130, 530, 1130, 1230 or the plates 732, 932 (e.g., as illustrated in FIGS. 22-24, 30-32, and 35-37).

Although the invention has been described in detail referring to certain preferred embodiments, variations and modifications exist within the scope and spirit of one or more independent aspects of the invention as described.

What is claimed is:

1. A mining machine comprising:

a base having two drive tracks configured to rest on a ground surface and to move the mining machine along a first direction, wherein the drive tracks each have a length along the first direction between a front end of the drive track and a rear end of the drive track;

a carbody that extends between the two drive tracks, wherein the carbody includes a turntable, wherein the turntable is coupled to a frame, and defines an axis of rotation of the frame relative to the two drive tracks;

a stabilizer appendage coupled to the carbody, wherein the stabilizer appendage extends forward from the carbody along the first direction and is configured to contact the ground surface and provide stabilizing support during a digging operation;

an actuator coupled to the stabilizer appendage to move the stabilizer appendage between a first position and a second position;

wherein the stabilizer appendage includes two link arms and a support element that extends between the two link arms, wherein the actuator is configured to generate rotational movement of the two link arms to raise and lower the support element, wherein the support element is configured to contact the ground surface during the digging operation and is configured to be raised above the ground surface when not in the digging operation, and wherein the support element is further configured to rotate on a second axis spaced forward of the drive tracks; and wherein the axis of rotation is positioned closer to the front ends of the drive tracks than the rear ends of the drive tracks.

2. The mining machine of claim 1, wherein the first position is a lowered position relative to the ground surface and the second position is a raised position relative to the ground surface.

3. The mining machine of claim 1, wherein the support element is a roller configured to rotate about the second axis, wherein the roller has a generally cylindrical shape, with a main outer surface and two chamfered surfaces on either side of the main outer surface.

4. The mining machine of claim 1, wherein the actuator is pivotally coupled to the carbody.

5. The mining machine of claim 1, wherein tipping loads are configured to flow directly into the carbody via the stabilizer appendage.

6. The mining machine of claim 1, further comprising a dipper configured to rotate about the axis of rotation, wherein the two drive tracks and the stabilizer appendage are positioned such that a swing profile of the dipper is uninterrupted by the drive tracks and the stabilizer appendage when the dipper is in a fully tucked position.

7. The mining machine of claim 1, further comprising a controller coupled to the stabilizer appendage, wherein the controller is configured to automatically raise or lower the stabilizer appendage depending upon whether the shovel is in a digging operation or a propel operation.

8. The mining machine of claim 7, further comprising an actuator coupled to the stabilizer appendage, the actuator including a cylinder, wherein if a cylinder pressure reaches or exceeds a predetermined threshold, the controller is configured to either alert an operator to cease digging or reduce digging loads, or to automatically reduce an available hoist bail speed and torque.

9. The mining machine of claim 1, wherein the support element includes chamfered surfaces along a perimeter of the support element configured to facilitate plowing of material away from the support element.

10. The mining machine of claim 1, wherein the support element is a plate.

11. The mining machine of claim 1, wherein the support element is a roller.

12. The mining machine of claim 1, wherein the support element is configured to swivel about a bearing that is coupled to the two link arms, wherein the second axis is a swivel axis.

13. A mining machine comprising:

a base having two drive tracks configured to rest on a ground surface;

a carbody that extends between the two drive tracks, wherein the carbody includes a turntable, wherein the turntable is coupled to a frame, and defines an axis of rotation of the frame relative to the two drive tracks;

a boom coupled to the frame;

a dipper coupled to the boom, wherein the frame, the boom, and the dipper are configured to rotate about the axis of rotation, wherein the rotation of the dipper about the axis of rotation defines a swing profile of the dipper; and a stabilizer appendage coupled to the carbody and extending forwardly from the carbody and toward the dipper when the dipper is in a fully tucked position and contacting the ground surface, wherein the stabilizer appendage is configured to contact the ground surface at a location behind the dipper and provide stabilizing support during a digging operation; and wherein the two drive tracks and the stabilizer appendage are positioned relative to the dipper such that the swing profile is uninterrupted by the drive tracks and the stabilizer appendage when the dipper is in the fully tucked position and is rotating about the axis of rotation, wherein the fully tucked position is a position wherein the dipper is pulled back toward a rear of the mining machine, wherein the shape and size and height of both the drive tracks and the stabilizer appendage are such that the dipper remains spaced from and does not physically contact the drive tracks or the stabilizer appendage when rotating about the axis of rotation in the swing profile;

wherein the stabilizer appendage is spaced from the frame, such that a position of the stabilizer appendage is independent of a position of the frame;

wherein the stabilizer appendage includes two link arms and a support element that extends between the two link arms;

wherein the support element is configured to swivel about a bearing that is coupled to the two link arms;

wherein the axis of rotation is a first axis;

wherein the support element is configured to rotate on a second axis spaced forward of the drive tracks; and wherein the second axis is a swivel axis.

14. The mining machine of claim 13, wherein the two drive tracks are configured to move the mining machine along a first direction, wherein the drive tracks each have a length along the first direction between a front end of the drive track and a rear end of the drive track, wherein the axis of rotation is positioned closer to the front ends of the drive tracks than the rear ends of the drive tracks, and wherein the stabilizer appendage extends forward farther than the front ends of the drive tracks along the first direction.

15. The mining machine of claim 14, wherein the dipper is configured to be positioned above the stabilizer appendage when in the fully tucked position.

16. The mining machine of claim 13, further comprising an actuator coupled to the stabilizer appendage to move the stabilizer appendage between a first position and a second position.

17. A mining machine comprising:

a base having two drive tracks configured to rest on a ground surface and to move the mining machine along a first direction;

a carbody that extends between the two drive tracks, wherein the carbody includes a turntable, wherein the turntable is coupled to a frame, and defines an axis of rotation of the frame relative to the two drive tracks; and a stabilizer appendage coupled to the carbody, wherein the stabilizer appendage extends forward from the carbody along the first direction and is configured to contact the ground surface and provide stabilizing support during a digging operation;

wherein the stabilizer appendage is spaced from the frame, such that a position of the stabilizer appendage is independent of a position of the frame;

wherein the stabilizer appendage includes two link arms and a support element that extends between the two link arms;

wherein the support element is configured to swivel about a bearing that is coupled to the two link arms;

wherein the axis of rotation is a first axis; and wherein the support element is further configured to rotate on a second axis spaced forward of the drive tracks, wherein the second axis is a swivel axis.

18. The mining machine of claim 17, wherein the drive tracks each have a length along the first direction between a front end of the drive track and a rear end of the drive track, wherein the axis of rotation is positioned closer to the front ends of the drive tracks than the rear ends of the drive tracks.

19. The mining machine of claim 17, further comprising an actuator coupled to the stabilizer appendage to move the stabilizer appendage between a first position and a second position.

20. The mining machine of claim 17, wherein the stabilizer appendage is located outside of the square outer profile on a side of the square outer profile located nearest the axis of rotation of the frame.

* * * * *